US006850728B2

(12) United States Patent
Yokozeki et al.

(10) Patent No.: US 6,850,728 B2
(45) Date of Patent: Feb. 1, 2005

(54) INDUCTION HEATING ROLLER APPARATUS, FIXING APPARATUS AND IMAGE FORMATION APPARATUS

(75) Inventors: Ichiro Yokozeki, Kanagawa-ken (JP); Takayuki Ogasawara, Kanagawa-ken (JP); Takaaki Tanaka, Kanagawa-ken (JP); Toshiya Suzuki, Kanagawa-ken (JP)

(73) Assignee: Harison Toshiba Lighting Corp., Imabari (JP)

( * ) Notice: Subject to any disclaimer, the term of this patent is extended or adjusted under 35 U.S.C. 154(b) by 0 days.

(21) Appl. No.: 10/414,304

(22) Filed: Apr. 16, 2003

(65) Prior Publication Data

US 2004/0005176 A1 Jan. 8, 2004

(30) Foreign Application Priority Data

Apr. 17, 2002 (JP) ..... 2002-114732
Apr. 23, 2002 (JP) ..... 2002-120365
Apr. 24, 2002 (JP) ..... 2002-122740

(51) Int. Cl.[7] ..... G03G 15/20

(52) U.S. Cl. ..... 399/328; 219/216; 219/619; 399/45; 399/69; 399/334

(58) Field of Search ..... 399/328, 330, 399/334, 67, 69, 45; 219/216, 619, 671, 469, 470, 255; 118/60; 347/156

(56) References Cited

U.S. PATENT DOCUMENTS 5,752,150 A 5/1998 Kato et al. ..... 399/330
5,991,569 A 11/1999 Sugihara et al. ..... 399/113
6,298,215 B1 * 10/2001 Nomura et al. ..... 399/328
6,336,027 B1 * 1/2002 Sakai et al. ..... 399/328
6,573,485 B2 6/2003 Yokozeki ..... 219/619
6,725,000 B2 * 4/2004 Takagi et al. ..... 399/69
2002/0125244 A1 9/2002 Yokozeki et al. ..... 219/619
2003/0000943 A1 * 1/2003 Yokozeki ..... 219/619
2003/0198481 A1 * 10/2003 Kikuchi et al. ..... 399/69
2003/0213799 A1 * 11/2003 Tanaka et al. ..... 219/619

FOREIGN PATENT DOCUMENTS

JP 59-33787 2/1984
JP 2000-215971 8/2000
JP 2000-215974 8/2000
JP 2002-164159 6/2002
JP 2002-229355 * 8/2002

* cited by examiner

*Primary Examiner*—Sophia S. Chen
(74) *Attorney, Agent, or Firm*—Finnegan, Henderson, Farabow, Garrett & Dunner, L.L.P.

(57) ABSTRACT

An induction heating roller apparatus has a heating roller capable of switching among a plurality of heating areas of different lengths according to a size of an object to be heated, a plurality of first induction coils opposed to a plurality of heating areas of the heating roller, and second induction coils placed opposite a part astride adjacent heating areas of the heating roller. A high frequency power supply provides high frequency power to the first and second induction coils. High frequency output is selectively supplied to the first induction coils and the second induction coils.

16 Claims, 23 Drawing Sheets

INDUCTION HEATING ROLLER APPARATUS, FIXING APPARATUS AND IMAGE FORMATION APPARATUS

BACKGROUND OF THE INVENTION

1. Field of the Invention

The present invention relates to an induction heating roller apparatus and to a fixing apparatus and an image formation apparatus, which are provided with the fixing apparatus.

2. Description of the Prior Art

Heating rollers, which employ halogen lamps as heat sources, are used in the prior art to thermally fix a toner image. However, the halogen lamp heat sources are inefficient and require a large amount of power. Accordingly, a technique involving induction heating is being developed to solve such problems.

Japanese Patent Laid-Open No. 2000-215974 describes an exciting coil, which is arranged near a heated object. The exciting coil generates an induction current in the heated object, which is a magnetic heating roller. The exciting coil is formed by winding a coil in a planar manner along a curved surface of the heated object. A magnetic core is arranged along the curved surface or the exciting coil on the side opposite to the heated object at the longitudinal ends of the exciting coil (first prior art example).

Japanese Patent Laid-Open No. 2000-215971 describes an induction heating apparatus having a heating rotor, or heating roller, which generates heat by means of electromagnetic induction, and a magnetic flux generating means, which is arranged in the heating rotor. The magnetic flux generating means includes a magnetic core and an electromagnetic conversion coil, which is wound about the core. The magnetic core includes a core portion, about which the electromagnetic conversion coil is wound, and a magnetic flux induction core portion. The magnetic flux induction core portion, which has a magnetic gap between its distal ends, concentrates magnetic flux at part of a heating rotor rather than the core portion (second prior art example).

The first and second prior art examples employ a heating technique that uses eddy current loss (hereafter referred to as eddy current loss technique). Such heating technique works under the same principle as that applied to IH jars. The frequency of the high frequency employed in the eddy current loss technique is about 20 to 100 kHz.

In comparison, Japanese Patent Laid-Open No. 59-33787 describes a high frequency induction heating roller. The high frequency induction heating roller includes a cylindrical roller body, or heating roller, which is formed by a conductive member, a cylindrical bobbin, which is arranged in the roller body in concentricity with the roller body, and an induction coil, which is spirally wound about the periphery of the bobbin. When current flows through induction coil, the induction coil, which induces induction current in the roller body, is heated (third prior art example).

In the third prior art example, the cylindrical roller body functions as a secondary coil, which is a closed circuit, and the induction coil functions as a primary coil. This causes transformer coupling between the primary and secondary coils and induces a secondary voltage in the secondary coil of the cylindrical roller body. Based on the secondary voltage, a secondary current flows in the closed circuit of the secondary coil. This is a heating technique (hereafter referred to as a transformer technique) that heats a secondary resistor, which heats the cylindrical roller body. The transformer technique, which has a high stationary efficiency since its magnetic coupling is stronger than the eddy current loss technique, entirely heats the heating roller. Thus, the transformer technique is advantageous in that is simplifies the structure of a fixing apparatus in comparison to the first and second prior art examples. Further, when the operational frequency is 100 kHz or greater, and preferably a high frequency of 1 MHz or greater, the Q of the induction coil may be increased to increase the power transmission efficiency. This increases the total heating efficiency and reduces power consumption. Further, the heat capacity is much smaller than that of the eddy current loss technique. Accordingly, the transformer technique is preferable for increasing the speed of thermal fixing.

The inventors have invented a transformer coupling technique that efficiently heats the heating roller. In the transformer coupling technique, by forming a closed circuit, the secondary reactance of which is substantially equal to a secondary resistance of the heating roller that is air-core transformer coupled to an induction coil, the efficiency for transmitting power from the induction coil to the heating roller increases. This efficiently heats the heating roller. An application for a patent for this invention was applied for in Japanese Patent Application No. 2001-016335 by the present applicant. The invention reduces power consumption for induction heating of the heating roller and facilitates increasing the speed of thermal fixing.

In an image formation means, such as a copy machine or a printer, paper on which images are formed is selected from multiple sizes. To cope with such function, the heating area of the heating roller must be changed in accordance with the paper size.

SUMMARY OF THE INVENTION

Object of the Invention

An object of the present invention is to provide an induction heating roller apparatus having rendered temperature distribution in an axial direction of a heating roller variable and a fixing apparatus and an image formation apparatus having the induction heating roller apparatus.

An induction heating roller apparatus consistent with aspects of the present invention may comprise a plurality of first induction coils arranged separately in an axial direction of a heating roller and also arranged to be opposed to a plurality of heating areas of the heating roller for the sake of magnetically coupling to induction coils and generating heat with an induction current and also switching among the plurality of heating areas of different lengths according to a size of an object to be heated; and second induction coils placed opposite a part astride adjacent heating areas of the heating roller, and also having induction coil selection means for, by intervening between a high frequency power supply and selected first induction coils and adjacent second induction coils, selectively supplying high frequency output of the high frequency power supply to the selected first induction coils and adjacent second induction coils in order to selectively supply high frequency power from the high frequency power supply to the first induction coils opposed to the heating areas of the heating roller according to the size of the object to be heated and the second induction coils placed astride the heating areas.

[Induction Coils]

According to the present invention, the "induction coils" are means for interlinking a magnetic field generated therefrom with the heating roller and inducing a secondary current to the heating roller and also generating resistance heating so as to heat the heating roller as required. They are arranged separately in the axial direction of the heating roller, and are comprised of the first and second induction coils. And they are energized, that is, excited directly from a high frequency power supply mentioned later or by way of a matching circuit or a high frequency transmission line and magnetically coupled, that is, air-core-transfer-coupled for instance to the heating roller, and may be stationary against a rotating heating coil or may also rotate together with or separately from the heating roller. In the case of rotating, a rotary collector mechanism may intervene between a frequency-changeable high frequency power supply and the induction coils. "Air-core transfer coupling" does not mean only complete air-core transfer coupling but it includes the cases of transfer coupling which can be considered to be substantially air-core. If necessary, however, it may also be electromagnetic coupling by an eddy current loss heating method.

Furthermore, the induction coil may have a coil bobbin for supporting it as described below. The coil bobbin may form a winding groove for supporting the induction coil in a state of regular winding. It is possible to render the coil bobbin hollow and put through an electric supply line to be connected to the induction coil therein. However, it is also possible, by directly forming or adhere the induction coil with a synthetic resin or a vitreous material instead of the coil bobbin, to constitute a plurality of the induction coils to be maintained in predetermined shape.

Furthermore, the induction coils may be connected in parallel to a common high frequency power supply. If required, however, a plurality of induction coils may be series-connected. Furthermore, the induction coils may be connected to individual high frequency power supplies individually or dividedly in groups. In either form, the electric supply lead wire for feeding high frequency power to the induction coil from the high frequency power supply should be placed at a position close to an inner face or an outer face of the induction coil. When the electric supply lead wire extends into the interior of the induction coils, the magnetic flux that interlinks the electric supply lead wire increases if the electric supply lead wire is near the axis of the induction coils. This produces eddy current loss in the interior of the induction coils and decreases power transmission efficiency. Such state is not desirable. In comparison, the above structure decreases the magnetic flux that interlinks the electric supply lead wire. This suppresses a relative decrease in the power transmission efficiency.

Furthermore, the plurality of induction coils may have a fixed length or different lengths. The high frequency power supplied to the induction coils is generally in proportion to application time of a high frequency voltage in the case where the high frequency power supply is common. As opposed to this, a rise in temperature of the heating roller depends on the size of the high frequency power applied to the induction coils per induction coil unit length. Therefore, in the case where the application time of the high frequency voltage is the same, the rise in temperature of a relatively long induction coil is slower than that of a relatively short induction coil. Thus, in the case where each of the plurality of long and short induction coils heats an opposed area of the heating roller at the same temperature and promptly while being switched, the application time of the high frequency voltage should be changed almost in proportion to the lengths of induction coils. It is possible to have a configuration wherein such control is performed by induction coil selection means mentioned later.

Hereafter, the first and second induction coils will be described.

(First Induction Coils)

The first induction coils are placed at a position opposed to the heating areas of the heating roller, and mainly generate a high frequency magnetic field required for heating the heating areas. Therefore, the first induction coil has an axial direction length almost equal to or a little longer than the length of the heating area of the heating roller. In addition, the first induction coil may be either comprised of one induction coil as against an opposed heating area or comprised of the induction coils divided into a plurality.

(Second Induction Coils)

The second induction coils are place data position opposed to a part astride a pair of adjacent heating areas of the heating roller, and function so as to maintain the temperature distribution near an end of each heating area as required for that reason, the second induction coil is generally shorter than the first induction coil in the axial direction of the heating roller. If required, however, it may be as long as the first induction coil. In addition, the second induction coil is comprised of either one induction coil or a plurality of induction coils.

In addition, as to the relationship with the first induction coils, the second induction coil is allowed to have a form in which it is placed to be in a clearance formed between a pair of adjacent first induction coils. However, the pair of adjacent first induction coils is placed to have the ends thereof overlapping so that proportionality of temperature in the heating area can be further improved.

<High Frequency Power Supply>

The high frequency power supply generates the high frequency power and supplies it to the first and second induction coils in order to energize the first and second induction coils. However, the frequency (or range) of the output of the high frequency power supply is basically not restricted. For the trans scheme, it is effective to be configured to output a high frequency of 1 MHz or more, since the Q of the induction coil may be increased to increase the power transmission efficiency, using a high frequency of 1 MHz or more. When the power transmission efficiency increases, the total heating efficiency increases and power consumption is reduced. In reality, however, it is feasible to render the problem of radiation noise as easily avoidable as possible by setting it at the frequency of 15 MHz or less. The preferred frequency is 1 to 4 MHz from the viewpoint of the economy of the suitable active devices (e.g., MOSFET) and the simplicity for suppressing noise. Furthermore, the present invention may be an eddy current coupling method (eddy current heating method), and in that case, the frequency in the range of 20 to 100 kHz is suitable.

To generate a high frequency, the direct or indirect conversion of a DC or low frequency AC to a high frequency with an active device, such as a semiconductor switch device, is realistic. To obtain high frequency power from mw frequency AC, a rectifying means may be used to temporarily convert the low frequency AC to DC. The DC may be a smoothened DC formed by a smoothing circuit or a non-smoothened DC. To convert DC into a high frequency, circuit devices, such as an amplifier and an inverter, may be used. An E-grade amplifier, which has high power conversion efficiency, may be used as the amplifier. A half-bridge inverter may also be used. Further, the optimal active device is a MOSFET, which has a superior high frequency characteristic. A plurality of parallel-connected high frequency power supply circuits may be configured to synthesize the high frequency output of each high frequency power supply circuit before applying the high frequency output to the induction coils. This allows the output of each high frequency power supply circuit to be small and to use the MOSFET as the active device while obtaining the required power. This inexpensively and efficiently generates the high frequency.

Furthermore, the high frequency power supply may be placed in common to the first and second induction coils. If required, however, it is also allowed to place a plurality of high frequency power supplies individually or in groups to each induction coil in the case where the high frequency power supply is individually placed to the first and second induction coils or furthermore, the first and/or second induction coils are comprised of a plurality of induction coils. For instance, it is possible to place the first high frequency power supply in common to the first induction coils and the second high frequency power supply in common to the second induction coils.

Moreover, an output frequency of the high frequency power supply may be either fixed or variable. In the case where the induction coil selection means mentioned later is comprised of switch means, it is possible to select a desired induction coil and supply the high frequency power to the induction coil irrespective of whether the output frequency is fixed or variable. As opposed to this, in the case where the induction coil selection means is comprised of filter means and a resonance circuit, it is necessary to render the output frequency of the high frequency power supply variable. To render the output frequency of the high frequency power supply variable, known frequency variable means may be used, such as rendering an oscillation frequency of an excitation circuit variable. Further, when necessary, when the apparatus is activated, the power supplied to the apparatus may be greater than that during normal operation to quickly heat the rollers.

<For Induction Coil Selection Means>

The induction coil selection means is means for exerting control, by intervening between the high frequency power supply and the induction coils, to selectively supply high frequency output of the high frequency power supply to the desired induction coil, and may be comprised of the filter means, resonance circuit or switch means for instance. If there are one or more induction coils to constantly have the high frequency power supplied, of the plurality of induction coils, it is not necessary to have the induction coil selection means intervening between the induction coils and the high frequency power supply. However, it should have the configuration wherein the remaining induction coils have supply of the high frequency power controlled by the intervening induction coil selection means. Here after, configuration examples of the induction coil selection means will be described.

In addition, it is possible, by using the induction coil selection means, to change the application time of the high frequency power to the induction coils, thereby becoming possible to render the high frequency power supplied to the first and second induction coils per unit length the same and also change the applied power per unit length. To control the application time of the high frequency power, PWM control may be performed, for instance, in addition to change of the frequency. It thereby becomes possible, even in the case of seemingly the same application time, to render real application time for actually applying, the high frequency power different therefrom. The PWM control may be performed in each half cycle or at a relatively low frequency such as 1 to 100 Hz.

(Case with the Filter Means)

The filter means intervenes between the high frequency power supply in a frequency variable form and the induction coils and the frequency of a high frequency wave applied to the filter means is correspondingly changed so as to selectively supply the high frequency power mainly to, of the plurality of induction coils, the desired one or plurality of induction coils. As for a filter characteristic which the filter means should have, it may be any of a bandpass type, a band-blocking type, a low-pass type and a wide-pass type. The configuration of the filter means may be any of an analog type, an active type and a digital type. Furthermore, the filter means can be connected in series or in parallel to the induction coils.

Next, the relationship between the filter characteristic of the filter means and selective energization of the induction coils will be described. In the case where the filter characteristic is the bandpass type, if the variable high frequency power supply is controlled so that it outputs a frequency of the pass band, the induction coils connected to the filter means are energized by the high frequency power having passed the filter means, and so it is possible to selectively heat the area of the heating roller opposed to the induction coils. Therefore, to selectively switch the energization of two induction coils according to the frequency, two filter means of mutually different pass bands are prepared and one of them is connected to one induction coil and the other is connected to the other induction coil so as to switch output frequencies of the frequency-variable high frequency power supply to be within the respective pass bands. In the case where the filter characteristic of the filter means is the band-blocking type, to energize the induction coils, the frequencies of frequency bands other than a blocking band are outputted from the frequency-variable high frequency power supply. In the case where the induction coils are not selectively energized, the frequencies within the blocking band are outputted. In the case of the low-pass type and wide-pass type, it is possible to energize the induction coils of either of them by outputting the frequencies of the pass bands. In the case of not energizing them, pass band frequencies are outputted.

And the filter means controls the high frequency power passing the filter moans by selectively operating according to the frequencies of the high frequencies inputted thereto. Therefore, it is possible, by changing a power supply frequency, to selectively energize desired induction coils. For this reason, it is feasible to switch the lengths of the heating areas of the heating roller as desired.

As a portion for intervening between each induction coil and the frequency-variable high frequency power supply and controlling the high frequency power supplied to the induction coil is comprised of the filter means, it is possible, without being influenced by the configuration of the induction coils, to exert stable control.

(Case with the Resonance Circuit)

The resonance circuit is constituted with the induction coil as a resonance circuit element. As the induction coil mainly includes an inductance, it can generally constitute the resonance circuit by adding a capacitor. The resonance circuit may be either a series resonance circuit or a parallel. resonance circuit to the high frequency power supply in the frequency variable form. The former connects the series connection circuit of the induction coil and capacitor to the high frequency power supply in the frequency variable form. The latter connects the parallel circuit of the induction coil and capacitor to the high frequency power supply in the frequency variable form. If necessary, however, the inductance may be added in addition to the induction coil. And in the case of constituting a plurality of resonance circuits including the first and second induction coils as resonance circuit components, there should be at least two different kinds of resonance frequencies thereof.

Furthermore, if necessary, it is possible to constitute it to have at least two different values as to the size of Q which is selectivity together with the resonance frequencies among the plurality of resonance circuits. To be more specific, they are constituted so that the value Q of one resonance circuit is relatively smaller than that of the other. For instance, in the case where there are three or more induction coils and there are accordingly three or more resonance circuits attached to them, they should be differentiated so that there are two or three kinds of the sizes of the resonance frequency and value Q of each resonance circuit. In the case where, of the plurality of induction coils, there are a main induction coil opposed to the heating area of the heating roller heated relatively in common and a sub-induction coil opposed to the heating area of the heating roller selectively heated only when switched, Q of the resonance circuit attached to the main induction coil is set to be large. If Q is large, a resonance characteristic becomes precipitous and selectivity becomes strong. As opposed to this, Q of the resonance circuit attached to the sub-induction coil is set to be small. If Q is small, the resonance characteristic becomes loose and the selectivity becomes weak. If required, however, it is possible to constitute them inversely.

And when the resonance circuit of the large Q is in tune with the output frequency of the high frequency power supply and the main induction coil is energized, the resonance circuit of the small Q is also in tune to an extent, and so the sub-induction coil is also slightly energized. For that reason, the heating area to which the sub-induction coil is opposed is preheated. Thus, when the sub-induction coil is selected next and starts to be energized, the temperature of the heating area of the heating roller rises earlier.

(Case with the Switch Means)

The switch means may be either in a contact form or in a no contact form. The switch means is generally connected in series to the induction coil. If necessary, however, it may be constituted, by making a parallel connection and shorting the induction coil, to block the supply of the high frequency power to the induction coil. Moreover, the latter connection form allows a plurality of induction coils to be serially connected to the high frequency power supply.

It is also possible, in addition to providing the switch means to all of the plurality of induction coils, to constitute them so that, without providing the switch means to a part of the induction coils as required, the high frequency power will be constantly supplied to the induction coils. In the case of switching the heating areas of the heating roller, such induction coils are always opposed to the common heating areas which are heated irrespective of the length thereof. However, the remaining induction coils are constituted to connect to the high frequency power supply via the switch means.

Furthermore, when selectively supplying the high frequency power to a desired induction coil with the switch means, it is possible, by using the control means and thereby temporarily stopping the high frequency output of the high frequency power supply, to reduce contact capacity of the switch means and securely switch the induction coils with high reliability. The control means either may or may not mechanically or electrically work with the switch means. In either case, if the high frequency output of the switch means is controlled to temporarily stop when switching the induction coils with the switch means, a specific configuration thereof does not matter. As the heating roller has thermal inertia, it is possible, If the stop time of the high frequency output is within 1 second or suitably within 0.5 second, to avoid undesired reduction in the temperature of the heating roller.

<Heating Roller>

The heating roller is constituted to be magnetically coupled to the induction coils described later to generate heat with the induction current and also to be switched among the plurality of heating areas of different lengths according to the size of the object to be heated. For this purpose, the heating roller includes a secondary coil, which forms a closed circuit The secondary coil is magnetically coupled, for example, air-core transformer coupled to an induction coil. In the latter case, a secondary side resistance value of the closed circuit has a value that is substantially equal to a secondary reactance of the secondary coil. The secondary side resistance and the secondary reactance being "substantially equal" refers to a range that satisfies equation 1 when the secondary side resistance is represented by Ra, the secondary reactance is represented by Xa, and $\alpha$=Ra/Xa. The reason for prescribing the mathematical requirements is disclosed in Japanese Patent Application No. 2001-016335 filed by the inventors hereof. Further, the secondary side resistance may be obtained through measurements. The secondary reactance may be obtained through calculations. The secondary resistance can be determined by calculation. Furthermore, $\alpha$ should preferably be in the range of 0.25 to 4 times, and in the range of 0.5 to 2 times at the optimum.

$$0.1<\alpha<10 \quad \text{[Equation 1]}$$

The heating roller may include one or more than one secondary coil. When there is more than one secondary coil, it is preferred that the secondary coils be arranged in the axial direction separated from one another. A roller base made of an insulating substance may be used in order to support the secondary coils. And the secondary coils may be placed on the outer face or inner face of the roller base or inside the roller base.

Furthermore, the heating roller has the heating areas of a plurality of lengths formed according to the size of the object to be heated. To be more specific, it is constituted, in the case of using the heating roller for fixing the toner image and so on, to change the heating area according to the paper size. The change of the heating area is due to collaboration with the induction coils mentioned later. The heating area will be described by taking the case of fixing the toner image as an example. For instance, in the case of fixing the toner image of A4 size paper, the necessary length of the heating area is different depending on whether the paper is fixed in portrait or landscape orientation. Also, the width of the heating area is different between the case of fixing A-4 size paper and the case of B-4 size paper. On the other hand, it is waste of the power to heat the areas other than the heating area required for the fixing, which must be avoided. On the other hand, even heating is required in the required heating area. In the case of two different heating areas, there are a common heating part for contributing to all the heating areas in common and a single heating part for contributing only to each heating area. Furthermore, as for the forms of placing the common heating part and single heating part, there are the form of putting the common heating part to either the right or left side and placing the single heating part to the other side and the form of placing the common heating part in the middle and placing the single heating parts on the right and left thereof. Either case thereof is acceptable according to the present invention.

Further, the secondary coil may be formed from a conductive body, such as a conductive layer, a conductive wire, or a conductive plate. To obtain the required secondary side resistance, the conductive layer may be made from the following material in the following manner. When forming the conductive layer though a thick film formation technique (application and sintering) it is preferred that the material be selected from a group consisting of Ag, Ag+Pd, Au, Pt, $RuO_2$, and C. To apply the material, a screen printing technique, a roll coater technique, or a spraying technique may be employed. In comparison, when forming the conductive layer through vapor deposition or sputtering, it is preferred that the conductive layer be made of a material selected from a group consisting of Au, Ag, Ni, and Cu+(Au, Ag). It is preferred that Cu and Al be used to form the conductive wire and the conductive plate. In the case of Cu and Al, it is desirable to form a rustproof coat on the surface in order to prevent oxidation. In the case of constituting the roller base with Fe and SUS (stainless steel), the surface coat of the roller base works as the secondary coils due to a skin effect of a high frequency. Therefore, it is not necessary to place special secondary coils as described above. Even in this case, however, it is possible to place the secondary coils apart from the roller base if required. Moreover, the roller base comprised of Fe and SUS can also have the rustproof coat such as a zinc coat formed on the surface.

To obtain a further virtual heating roller, it is preferred that the following elements be added.

1. Roller Base

A roller base, which is made of an insulative material, may be used to support the secondary coil. In this case, the secondary coil may be arranged on the outer surface, the inner surface, or in the interior of the roller body. The insulative roller body may be formed from ceramic or glass. Taking into consideration, the heat resistant characteristic, the impact resistant characteristic, and the mechanical strength of the roller body, the following materials may be used. For example, the ceramic may be alumina, mullite, aluminum nitride, or silicon nitride. For example, the glass may be crystallized glass, quartz glass, or Pyrex®.

2. Heat Diffusion Layer

A heat diffusion layer, which is used as a means for improving the uniformity of temperature in the axial direction of the heating roller, may be arranged on the upper side of the conductive layer when necessary. Thus, it is preferred that a substance exhibiting satisfactory thermal conduction in the axial direction of the heating roller be used. Metals having high electric conductivity, such as Au, al, Au, Ag, and Pt, often include substances having high thermal conduction. It is required that the heat diffusion layer have thermal conduction that is equal to or greater than that of the material of the conductive layer. Accordingly, the heat diffusion layer may be formed from the same material as the conductive layer.

Further, when the heat diffusion layer is formed from a conductive substance, the heat diffusion layer may conductively contact the conductive layer. However, by arranging the heat diffusion layer on an insulating film, noise would be shut out. Since a high frequency magnetic field does not reach the heat diffusion layer, a secondary current that contributes to heating is not induced in the heat diffusion layer.

3. Protection Layer

A protection layer is employed when necessary to mechanically protect and electrically insulate the heating roller or to improve the elastic contact characteristic or toner separation characteristic of the heating roller Glass may be used as the material of a protection layer employed to mechanically protect and electrically insulate the heating roller. Synthetic resin may be used as the material of a protection layer employed to improve the elastic contact characteristic or toner separation characteristic of the heating roller. The material of the glass may be selected from a group consisting of zinc borosilicate glass, lead borosilicate glass, borosilicate glass, and aluminosilicate glass. The material of the synthetic resin may be selected from a group consisting of silicone resin, fluororesin, polyimide resin+fluororesin, and polyamide+fluororesin. When polyimide+fluororesin or polyamide+fluororesin are employed, fluororesin is arranged on the outer side.

4. Shape of Heating Roller

A crown may be formed on the heating roller if desired. The crown may be drum-like or barrel-like.

5. Rotating Mechanism of Heating Roller

A known mechanism may be employed as the mechanism for rotating the heating roller. In the case of heat-fixing the toner image, it is possible to have the configuration wherein a pressing roller is placed to be directly facing the heating roller so that, when a record medium having the toner image formed thereon passes between the two rollers, the toner is heated and fusion-bonded to the record medium.

<Action of the Present Invention>

If the high frequency power is applied to the plurality of induction coils, the high frequency magnetic field is generated from the induction coils and interlinks with a secondary coil of the heating roller. To be more specific, the induction coil becomes a primary coil, and a magnetic coupling, that is, a transfer coupling is made between the induction coil and the secondary coil. Consequently, the secondary coil forms a closed circuit, and so a secondary current runs inside it in a go-around direction of the heating roller. As the secondary coil has an adequate secondary-side resistance value, Joule heat is generated by the secondary current so that the temperature of the heating roller rises. In the case of the transfer coupling with a high frequency of 1 MHz or more, power transfer efficiency increases to 95 percent or more, for instance, due to air-core transfer coupling so that the power is saved.

According to the present invention, the second induction coils are placed opposite a part astride adjacent heating areas in addition to the first induction coils opposed to the heating areas of the heating roller, and there is the induction coil selection means furnished for, by intervening between the high frequency power supply and induction coils, selectively supplying the high frequency output of the high frequency power supply to the first induction coils opposed to the heating areas of the heating roller according to the sizes of the objects to be heated and second induction coils astride the heating areas of the heating roller. Therefore, when heating a certain heating area, the second induction coils astride the adjacent heating areas of the heating roller are also energized so that the proportionality of temperature distribution in the heating areas becomes good. In the case of heating the adjacent heating areas according to different sizes of the objects to be heated, the second induction coils are energized so that the proportionality of temperature distribution becomes good likewise in the heating areas of different lengths. In short, the second induction coils function in common to two adjacent heating areas.

Therefore, in the case of using an induction coil apparatus for fixing a toner image on the image formation apparatus, only the areas suited to the paper size are preferentially heated when increasing the temperature of the heating roller, and the proportionality of temperature distribution in each heating area becomes good.

Furthermore, according to the present invention, it becomes easier to set various heating areas on the heating roller. A description will be given as follows by taking as an example a configuration wherein a second induction coil IC2 is placed between a pair of adjacent first induction coils IC1 and IC3 shown in FIG. 1. To be more specific, if a part of the heating roller opposed to one first induction coil IC1 is a heating area A and a part opposed to the other first induction coil IC3 is a heating area B, the first induction coil IC1 and second induction coil IC2 are simultaneously energized when heating the heating area A. Consequently, the heating area A is evenly heated because it is opposed to a central portion of the induction coils IC1 and IC2. In the case of heating the heating area B, the other first induction coil IC3 and the second induction coil IC2 are simultaneously energized. Consequently, the heating area B is evenly heated for the same reason as above. Furthermore, if the first induction coils IC1, IC3 and the second induction coil IC2 are energized, a heating area C comprised of the consecutive heating areas A and B can be evenly heated.

In summary, it is possible to set the heating areas A, B and C.

Furthermore, it is possible, by using the filter means as the induction coil selection means, to simultaneously energize the first and second induction coils so as to heat a desired area of the heating roller. For instance, in the above heating area switching form, a passing frequency of the induction coil selection means on supplying the high frequency power to the induction coil a is f1. And the passing frequency of the induction coil selection means on supplying the high frequency power to the induction coil b is f2. Furthermore, the passing frequency of the induction coil selection means on supplying the high frequency power to the induction coil c is f3.

In the above configuration, control is exerted to sequentially and cyclically switch the output frequency of the high frequency power supply at a predetermined low frequency from f1 to f2, and further to f3. Consequently, the induction coils a, b and c are seemingly energized at the same time while being PWM-controlled at the low frequency, and so the heating areas A and B of the heating roller are heated at the same time. Therefore, if the heating areas A+B are the heating area C, it is possible to heat the induction coils a, b and c at the same time so as to heat the heating area C which is wider.

Next, control is exerted to sequentially and cyclically switch the output frequency of the high frequency power supply at a predetermined low frequency from f1 to f3 so that the heating area A of the heating roller can be heated.

Furthermore, control is exerted to sequentially and cyclically switch the output frequency of the high frequency power supply at the predetermined low frequency from f2 to f3 so that the heating area B of the heating roller can be heated.

Even in the case where the induction coil selection means is the resonance circuit, it basically works like the above filter means.

According to the present invention, it is possible, by having the configuration described above, to provide the induction heating roller apparatus wherein the temperature distribution in the axial direction of the heating roller is rendered variable, the temperature distribution is even in any heating area and besides, various heating areas can be easily set.

Favorable Embodiment of the Invention

Function of the Embodiment

Advantage of the Embodiment

According to a first preferable embodiment of the present invention, the second induction coil is placed between the first induction coils opposed to the adjacent heating areas of the heating roller.

According to the first embodiment, the outer face of the induction coil is even due to the above configuration. For this reason, it is possible to obtain a high magnetic coupling by approximating the induction coil to the heating roller.

According to a second preferable embodiment of the present invention, the second induction coil is placed with its both ends overlapping the first induction coils opposed to the adjacent heating areas of the heating roller.

And according to the second embodiment, it becomes even easier, by the above configuration, to equalize the temperature distribution in the heating areas of the heating roller opposed to the first and second induction coils.

As the first and second induction coils are overlapping at both ends, it is possible to render a coil pitch relatively larger so that the magnetic field of the portion will not become too strong to excessively increase the temperature of the heating roller.

According to a third preferable embodiment of the present invention, the high frequency power supply is the frequency-variable high frequency power supply capable of feeding the power to a plurality of the first and second induction coils in common and having a variable output frequency, and the induction coil selection means is the filter means which intervenes between the frequency-variable high frequency power supply and the induction coils and controls the high frequency power which is passing by selectively operating according to the frequencies.

According to this embodiment, if there are one or more induction coils, of the plurality of induction coils, to have the high frequency power constantly supplied, it is not necessary to have the filter means intervene between the induction coils and frequency-variable high frequency power supply. However, the remaining induction coils are constituted to have the supply of the high frequency power controlled by the intervening filter means.

And according to the third embodiment, the filter means intervenes between the plurality of induction coils and the frequency-variable high frequency power supply, and controls the high frequency power passing the filter means by selectively operating according to the frequencies. Therefore, it is possible, by changing the power supply frequency, to selectively energize a desired induction coil. For this reason, it is possible to switch the lengths of the heating areas of the heating roller as desired. In the case of using the induction coil apparatus for fixing the toner image on the image formation apparatus, it is possible to preferentially heat only the areas suited to the paper size when increasing the temperature of the heating roller. However, if the filter means is constituted to have the high frequency power simultaneously supplied to the plurality of induction coils and the frequency is selected so that a plurality of filter means become the pass bands respectively, it is possible to heat the induction coils to be almost at an equal temperature. For this reason, it is possible to heat them to be suited to a large paper size.

Next, the relationship between the filter characteristic of the filter means and the selective energization of the induction coils will be described. In the case where the filter characteristic is the bandpass type, if the variable high frequency power supply is controlled so that it outputs the frequency of the pass band, the induction coils connected to the filter means are energized by the high frequency power having passed the filter means, and so it is possible to selectively heat the area of the heating roller opposed to the induction coils. Therefore, to selectively switch the energization of two induction coils according to the frequency, for instance, two filter means of mutually different pass bands are prepared and one of them is connected to one induction coil and the other is connected to the other induction coil so as to switch the output frequencies of the frequency-variable high frequency power supply to be within the respective pass bands. In the case where the filter characteristic of the filter means is the band-blocking type, to energize the induction coils, the frequencies of the frequency bands other than the blocking band are outputted from the frequency-variable high frequency power supply. In the case where the induction coils are not selectively energized, the frequencies within the blocking band are outputted. In the case of the low-pass type and wide-pass type, it is possible to energize the induction coils of either of them by outputting the frequencies of the pass bands. In the case of not energizing them, pass band frequencies are outputted.

Furthermore, as the portion for intervening between each induction coil and the frequency-variable high frequency power supply and controlling the high frequency power supplied to the induction coil is comprised of the filter means, it is possible, without being influenced by the configuration of the induction coils, to exert stable control.

According to a fourth preferable embodiment of the present invention, the high frequency power supply is the frequency-variable high frequency power supply capable of feeding the power to a plurality of the first induction coils in common and having a variable output frequency, and the induction coil selection means is a plurality of the resonance circuits which intervene between the frequency-variable high frequency power supply and the induction coils and is constituted to include the induction coils as resonance circuit elements and have the resonance frequencies and value Q of different sizes.

The fourth embodiment relates to an improvement in the configuration wherein the plurality of induction coils are switched by using the resonance circuits.

As for the induction coils, it is allowed, for the sake of reducing the size of Q of the resonance circuits described later, to form them by using conductors of a relatively large resistance value if required. It is also possible to connect an external resistor to the induction coil.

The resonance circuit is constituted with the induction coil as the resonance circuit element. As the induction coil mainly includes an inductance, it can generally constitute the resonance circuit by adding a capacitor. The resonance circuit may be either a series resonance circuit or a parallel resonance circuit to the frequency-variable high frequency power supply. The former connects the series connection circuit of the induction coil and capacitor to the frequency-variable high frequency power supply. The latter connects the parallel circuit of the induction coil and capacitor to the frequency-variable high frequency power supply. If necessary, however, the inductance may be added in addition to the induction coil.

As for the plurality of resonance circuits including the plurality of induction coils, there are at least two different values of the resonance frequency and the size of Q respectively. To be more specific, the resonance frequency of one of them and that of the other are mutually different. As for the size of Q, one is relatively large but the other is relatively small. For instance, in the case where there are three or more induction coils and so there are three or more resonance circuits attached to them, they are differentiated so that there are two or three kinds of the sizes of the resonance frequency and value Q of each resonance circuit. For instance, in the case where, of the plurality of induction coils, there are a first induction coil opposed to the heating area of the heating roller heated relatively in common and a second induction coil opposed to the heating area of the heating roller selectively heated only when switched, Q of the resonance circuit attached to the first induction coil is set to be large. If Q is large, the resonance characteristic becomes precipitous and the selectivity becomes strong. As opposed to this, Q of the resonance circuit attached to the second induction coil is set to be small. If Q is small, the resonance characteristic becomes loose and the selectivity becomes weak. If required, however, it is possible to constitute them inversely.

Furthermore, it is allowed, if necessary, to have a configuration wherein, instead of providing the resonance circuits to all of the plurality of induction coils, no resonance circuit is provided to specific induction coils, that is, the induction coils opposed to the heating area of the heating roller heated constantly in common.

And the fourth embodiment is effective in the case where it is desired to selectively heat a specific portion of the heating roller in the axial direction by using the plurality of induction coils. To be more specific, if the output frequency of the frequency-variable high frequency power supply is changed to be in tune with the resonance frequency of the resonance circuit of which resonance circuit element is one of the induction coils opposed to the area of the heating roller desired to be selectively heated, it becomes possible to selectively supply the high frequency power to the induction coil. As opposed to this, the high frequency power will be supplied only a little or substantially not at all to the other induction coil constituting the resonance circuit not in tune. According to the present invention, however, Q of the resonance circuit of the other induction coil is small, resulting in loose resonance. For that reason, even if the output frequency of the frequency-variable high frequency power supply is the resonance frequency of the one induction coil, resonance is performed to an extent and the other induction coil is adequately energized. Consequently, it becomes possible to have the configuration wherein, when one area of the heating roller opposed to the one induction coil is in a heated state, the other area of the heating roller opposed to the other induction coil is maintained in a preheated state. For this reason, it is possible to increase the temperature of the other area earlier.

As opposed to this, when the output frequency of the frequency-variable high frequency power supply is the resonance frequency of the other induction coil, the resonance circuit of the one induction coil will not be in tune therewith, and so the one area will not be heated. However, if the output frequency of the frequency-variable high frequency power supply is the frequency to be in a resonance area of the resonance circuit of the one induction coil to an extent, it is possible to constitute it to maintain the one area of the heating roller opposed to the one induction coil in a preheated state because, as the resonance characteristic of the other induction coil is loose, the resonance circuit of the one induction coil is adequately resonated while sufficiently heating the other induction coil.

As described above, according to the fourth embodiment, it is possible to heat the selective areas of the heating roller in various ways because the sizes of the resonance frequencies of the plurality of resonance circuits and Q are different.

According to a fifth preferable embodiment of the present invention, a pair of adjacent induction coils are adjacent in a state of different winding directions.

The fifth embodiment defines the configuration wherein, in the case where the plurality of induction coils are separately arranged in the axial direction of the heating roller and are switchable, it is easy to check whether or not desired switching is adequately performed. To be more specific, adjacent ones of the plurality of induction coils have mutually different winding directions so that, when the pair of adjacent induction coils are simultaneously energized, the magnetic field is offset in an adjacent part of the induction coils, resulting in reduced magnetic field strength of the part. Consequently, the induction current generated in the area opposed to the adjacent part of the heating roller is reduced, and so the temperature rise is reduced and the temperature distribution in the area lowers. Thus, it is possible, by detecting the temperature of the adjacent part of the heating roller, to detect insufficient switching or incomplete switching of the heating area.

According to the fifth embodiment, the means for detecting the temperature of a part opposed to the adjacent part of the induction coils of the heating roller is not especially restricted. For instance, it is possible, by placing temperature detection means such as a thermistor at the part of the heating roller, to detect the temperature of the area. Moreover, it is possible, by connecting the temperature detection means to a safety circuit, to constitute it so that the safety circuit automatically operates when insufficient switching or incomplete switching of the heating area is detected. However, it may be constituted so that a display device or an alarm device operates instead of or in addition to it.

A sixth preferable embodiment of the present invention has power factor improvement means connected to the induction coils and placed at a position close to the induction coils, a high frequency transmission line for connecting the high frequency power supply and the induction coils, and a matching circuit intervening between the high frequency power supply and the high frequency transmission line and placed close to the high frequency power supply.

A seventh preferable embodiment of the present invention supports the induction coils on the rim side, and has a coil bobbin having a concave portion at least partially-formed thereon and the power factor improvement means placed in the concave portion of the coil bobbin.

The power factor improvement means is the means for rendering the power factor of a high frequency current running in the high frequency transmission line relatively higher, where reactance of the induction coils is mainly the inductance and so capacitance is added to reduce impedance so as to improve the power factor. The capacitance can be added to the circuit by connecting the capacitor to a position close to the induction coils on the terminal side of the high frequency transmission line. The position for connecting the capacitor may be either the inside or outside of the heating roller. In the case of placing the power factor improvement means inside the heating roller, a ceramic capacitor of high heat-resistance grade should be used.

The power factor improvement means can be connected in parallel or in series to the induction coils. Furthermore, the power factor improvement means can be placed in a state of being accommodated inside the heating roller if desired. However, it may also be placed to be positioned outside the heating roller. In addition, it is also possible to form the concave portion on the coil bobbin whether inside or outside the heating roller so as to place the power factor improvement means therein.

According to the seventh embodiment of the present invention, the "high frequency transmission line" means transmission means for supplying the high frequency power generated from the high frequency power supply to the induction coils by way of the matching circuit, which is a concept including two parallel lines, a coaxial line, a waveguide and so on. Therefore, the high frequency transmission line intervenes between the matching circuit and induction coils clear of each other, and electrically connects them. Inside the heating roller, the high frequency transmission line should be placed at a position close to the inner face or outer face of the induction coil. In the case of putting the high frequency transmission line comprised of the two parallel lines through the inside of the induction coil, it is not desirable to have the high frequency transmission line close to a central axis of the induction coil because, as the flux interlinking with the high frequency transmission line increases, eddy current loss arises inside and the power transmission efficiency is reduced. As opposed to this, the flux interlinking with the high frequency transmission line is reduced by constituting them as described above so as to relatively curb the reduction in the power transmission efficiency.

The matching circuit means circuit means for, in the case where an internal impedance and a load impedance of the high frequency power supply are different, intervening between them for the sake of performing impedance conversion and matching their impedances to increase the power transmission efficiency. A circuit configuration of the matching circuit is not especially restricted so that known various circuit configurations may be selected as appropriate and adopted. If seen from the matching circuit, however, the load includes the high frequency transmission line and induction coils, and so the induction coils and the high frequency power supply are not necessarily matched.

The seventh embodiment of the present invention has the above-mentioned configuration, where the power factor improvement means is connected to the induction coils at a position of the load close to the induction coils so that the power factor of the high frequency current running in the high frequency transmission line is improved to be higher and VA added to the high frequency transmission line is reduced. For that reason, it is possible to reduce a current capacity of the high frequency transmission line, and thus a thinner wire can be used so as to reduce the costs and facilitate wire running work. In addition, the high frequency current running in the high frequency transmission line becomes low so that radiation noise radiated from the high frequency transmission line decreases.

According to an eighth preferable embodiment of the present invention, the induction heating roller apparatus has the heating roller for getting magnetically coupled to the induction coils described later and generating heat with the induction current and also switching among the plurality of heating areas of different lengths according to the size of the object to be heated; and the plurality of induction coils separately arranged in the axial direction of the heating roller and opposed to the plurality of heating areas of the heating roller and having the length to get out of both ends of any heating area; the high frequency power supply for supplying the high frequency power to the plurality of induction coils; and the induction coil selection means for, by intervening between the high frequency power supply and induction coils, selectively supplying the high frequency output of the high frequency power supply to the induction coils opposed to the heating areas of the heating roller according to the size of the object to be heated.

According to the eighth embodiment, as for configuration of the induction coils, there may be either one coil or a plurality of coils against each heating area if opposed to the heating areas of the heating roller of different lengths according to the size of the object to be heated. The induction coil has the length to get out of both ends of any heating area. For instance, in the case where the heating areas are comprised of the heating area A which is the heating area of the heating roller extended from one end side to the other end side and the heating area B having the heating area A in common and the heating area C further added thereto, the induction coils placed opposite these heating areas are partially out of the heating areas for which they are responsible so as to obtain even temperature distribution along the entire length of each heating area. Therefore, as for the first induction coils placed opposite the heating area A, the length a in the axial direction of the heating roller is larger than that of the heating area A, and both ends thereof are out of both ends of the heating area A. The second induction coil opposed to the heating area B is constituted by adding the third induction coil to the first induction coil, and the length b in the axial direction of the heating roller is larger than that of the heating area B, and both ends thereof are out of both ends of the heating area B.

And according to the eighth embodiment, each heating area of the heating roller does not include an area generating a temperature gradient opposed to both ends of the induction coil, and so the proportionality of the temperature distribution in each heating area becomes good.

In addition, it is possible, even if the number of the induction coils is small, to set a plurality of heating areas of the heating roller of different widths so as to render the configuration relatively simple.

Furthermore, according to the eighth embodiment, it is possible to selectively combine the second to seventh embodiments already described, if desired.

Although it is not an essential constitutional requirement of the present invention, the following configurations may be selectively added, if desired, to improve the performance and increase the functions when implementing the present invention so as to obtain a further effective induction heating roller apparatus.

1. Coil Bobbin

In order to maintain the induction coils in predetermined shape and maintain placement positions as predetermined, it is possible to support the induction coils by using the coil bobbin manufactured by using a material of as little dielectric loss as possible and excellent heat resistance. In this case, the coil bobbin may be either hollow or filled inside. And it is possible to have a winding groove for regular winding and a wiring groove extended in the axial direction for accommodating the high frequency transmission line formed on the coil bobbin.

2. Warm-Up Control

When the operation of the apparatus is started, or when the apparatus is being warmed up after the supply of power starts, the heating roller is controlled so that it rotates at a speed lower than during normal operation.

3. Temperature Control of Heating Roller

To maintain the temperature of the heating roller within a predetermined range at a constant value, for example 200° C., the surface of the heating roller is in contact with a heat sensitive device in a thermally conductive manner. A thermistor having a negative temperature characteristic or a non-linear resistor having a positive temperature characteristic may be used as the heat sensitive device.

4. Transfer Sheet

When using the heating roller to heat a heated object, the heating roller may be directly pressed against the heated object. However, if necessary, a transfer sheet may be arranged between the heating roller and the heated object. In this case, the transfer sheet may be endless or roll-like. By using the transfer sheet, the heating and transferring of the heated object are performed smoothly.

A fixing apparatus according to the present invention is characterized by having a fixing apparatus including a pressing roller; and the induction heating roller apparatus consistent with the present invention placed to fix the toner image including the heating roller placed to face the pressing roller of the fixing apparatus proper in a pressure welding relationship while carrying a recording medium having the toner image formed thereon sandwiched between the rollers.

The "fixing apparatus proper" according to the present invention means the remaining portion of the fixing apparatus after eliminating the induction heating roller apparatus therefrom.

While the pressing roller and the heating roller may be directly pressed against each other. However, if necessary, a transfer sheet may be arranged in between the pressing roller and heating roller so that they are indirectly against each other. The transfer sheet may be endless or roll-like.

And according to the present invention, it is possible to fix the toner image at high speed while the recording medium on which the toner image is formed, is transferred in a state held between the heating roller and pressing roller.

The image formation apparatus according to the present invention is characterized by having an image formation apparatus proper having image formation means for forming the toner image on the recording medium; and the fixing apparatus consistent with the present invention placed on the image formation apparatus proper for fixing the toner image on the recording medium.

In the present invention, the image formation unit forms an image that forms image information on the recording medium through an indirect technique or a direct technique. The term "indirect technique" refers to a technique for forming an image through transcription.

The image formation apparatus corresponds to, for example, an electronic photograph copying machine, a printer, or a facsimile.

The recording medium corresponds to, for example, a transcription material sheet, a printing paper, an electronic facsimile sheet, or an electrostatic recording sheet.

And according to the present invention, it is possible to implement the image formation apparatus suited to a high-speed type.

DESCRIPTION OF THE PREFERRED EMBODIMENTS

Figure 2:
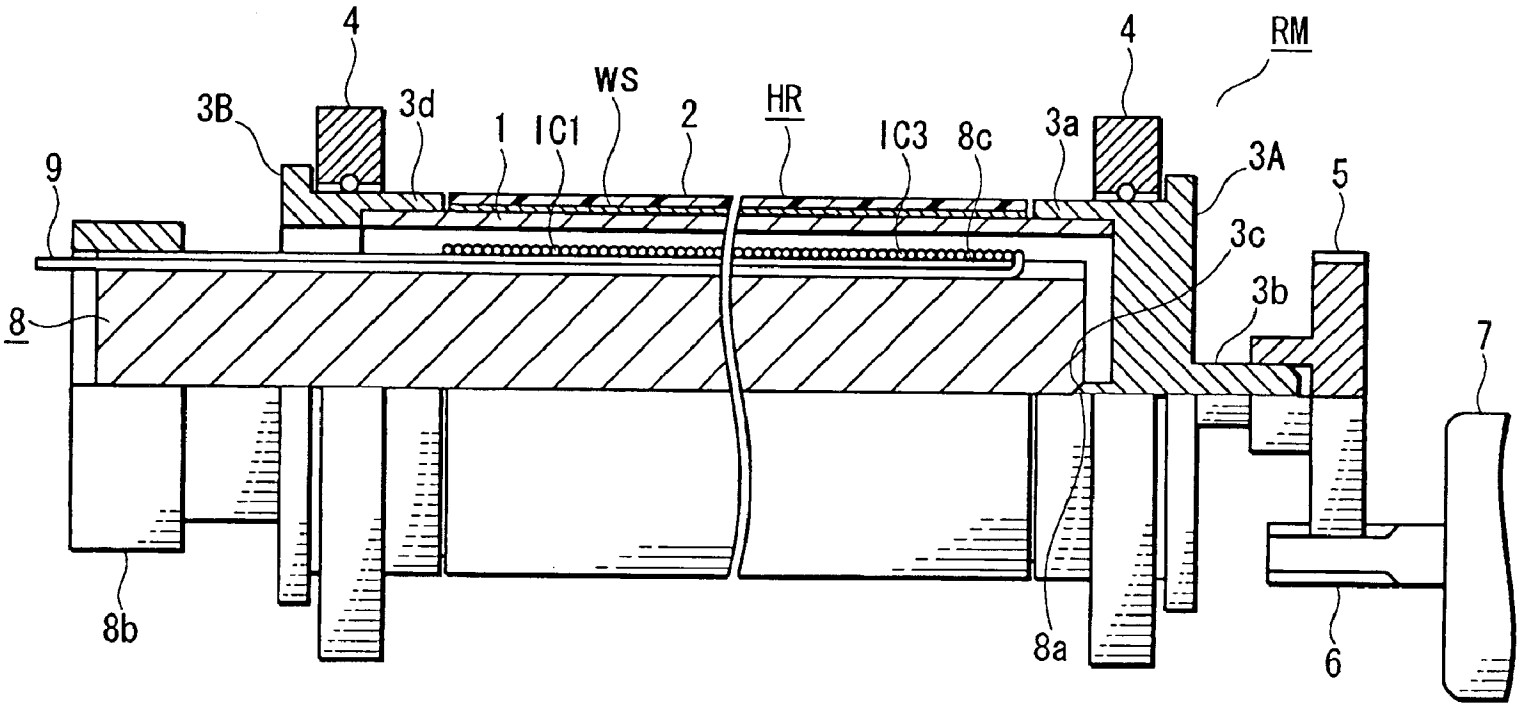
FIG. 2 is a partially cutaway front cross-sectional view of an induction coil an a heating roller.

In the first embodiment of the induction heating roller apparatus according to the present invention, the induction heating roller apparatus is comprised of a heating roller HR, first induction coils IC1 and IC3 and second induction coil IC2, a h high frequency power supply HFS and induction coil selection means F1, F2, and F3. In addition, as shown in FIG. 2, the heating roller HR has a rotating mechanism RM and is driven and rotated by it. Hereafter, the configuration of each of the components will be described in detail.

<Heating Roller HR>

The heating roller HR, which is driven by the rotating mechanism RM, includes a roller base 1, a secondary coil ws, and a protection layer 2. The roller base 1, which is a hollow cylindrical body and made of alumina ceramic, has, for example, a length of 300 mm and a thickness of 3 mm. The secondary coil ws is a CU vapor deposition film, which is formed from a film-like cylindrical single-turn coil, and arranged along the entire effective length in the axial direction on the outer surface of the roller base 1. The thickness of the secondary coil ws is set so that a secondary side resistance R in the circumferential direction of the heating roller HR is 1 Ω, the value of which is substantially the same as that of a secondary reactance. The protection layer 2 is made at fluororesin and formed by coating the outer surface of the secondary coil ws.

The rotating mechanism RM is a mechanism for rotating the heating roller HR. AS shown in FIG. 2, the rotating mechanism RM includes a first end member 3A, a second end member 3B, two bearings 4, a bevel gear 5, a spline gear 6, and a motor 7. The first end member 3A includes a cap 3*a*, a drive shaft 3*b*, and an inner end 3*c*. The left end of the cap 3*a*, as viewed in FIG. 2, is fitted on the heating roller HR and fixed to the heating roller HR by a bolt (not shown). The drive shaft 3*b* extends outward from the outer central portion of the cap 3*a*. The inner end 3*c* extends inward from the inner central portion of the cap 3*a*. The second end member 3B includes a ring 3*d*. The right end of the ring is fitted on the heating roller HR by a bolt (not shown). One of the two bearings 4 rotatably supports the outer surface of the cap 3*a* of the first end member 3A. The other one of the two bearings 4 rotetably support the outer surface of the second end member 3B. Accordingly, the heating roller HR is rotatably supported by the first and second end members 3A, 3B, which are connected to the ends of the heating roller HR, and the pair of bearings 4. The bevel gear 5 is attached to the drive shaft 3*b* of the first end member 3A. The spline gear 6 is meshed with the bevel gear 5. The motor 7 has a rotor shaft, which is directly connected to the spline gear 6.

<First Induction Coils IC1, IC3 and Second Induction Coil IC2>

Figure 3:
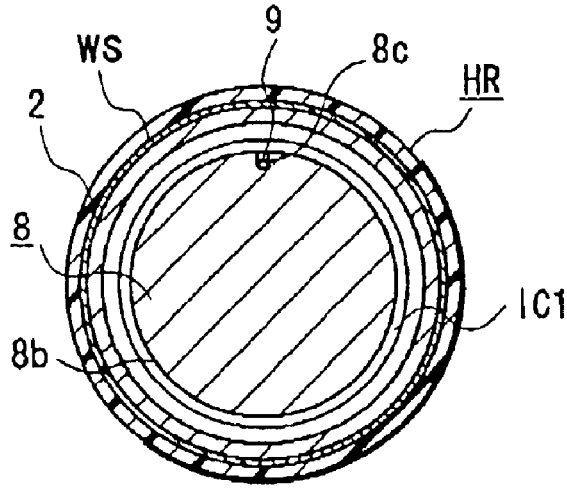
FIG. 3 is likewise a cross-sectional view of the induction coil and the heating roller.
Figure 4:
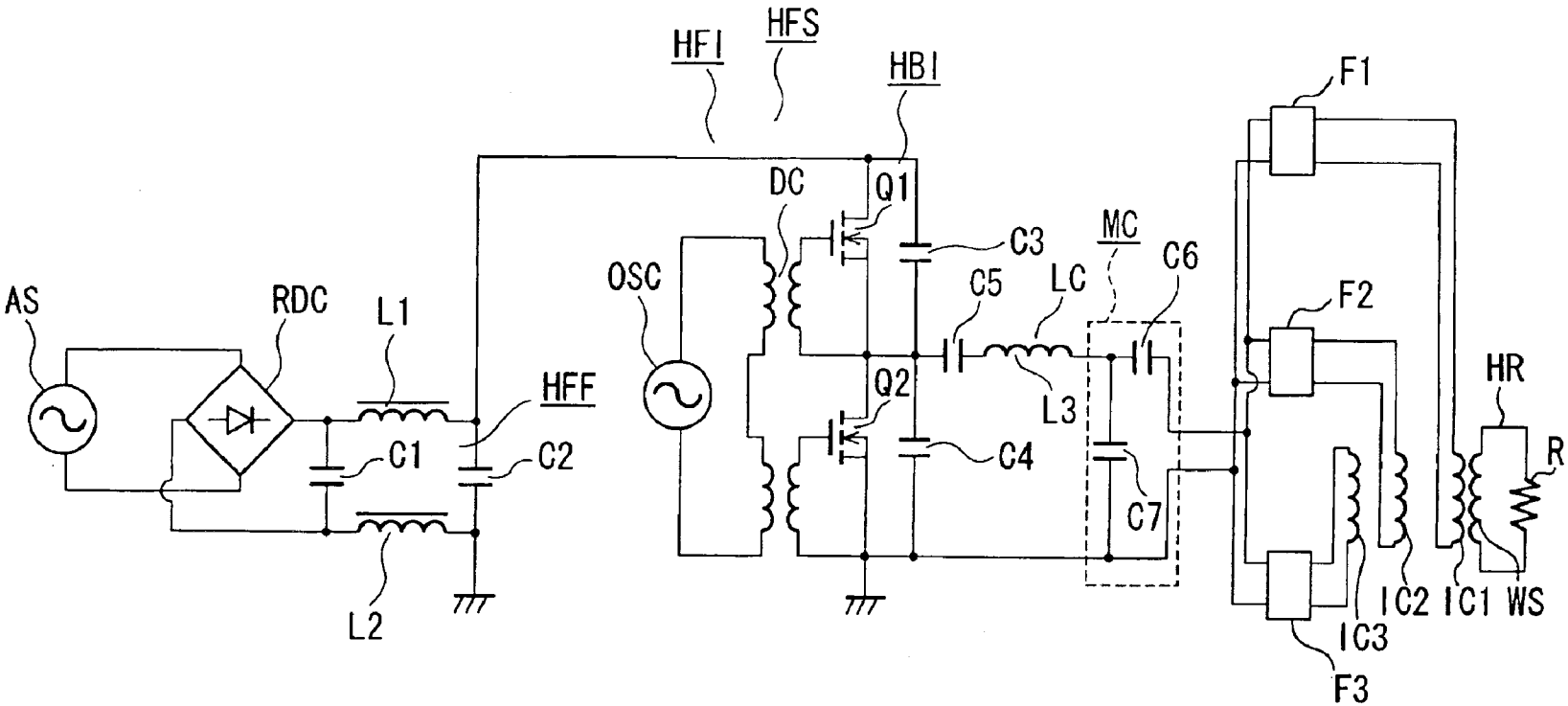
FIG. 4 is a circuit diagram of an electric circuit.

First induction coils IC1, IC3 are placed opposite the adjacent heating areas A and B of the heating roller HR. As opposed to this, the second induction coil IC2 is placed in a part astride heating areas A and B between a pair of adjacent first induction coils IC1 and IC3. And as shown in FIG. 4, the first and second induction coils IC1, IC3 and IC2 are magnetically coupled to secondary coils ws of the heating roller HR. And as shown in FIGS. 2 and 3, the first and second induction coils IC1, IC3 and IC2 are separately arranged in the axial direction of the heating roller HR by being wound around the coil bobbin 8. They are series-connected between a pair of feeding leads 9, and both ends are connected to output terminals of a high frequency power supply HFS described later via the feeding leads 9.

The coil bobbin 8 is comprised of a cylinder made from fluorocarbon resin, and has a concave portion 8*a*, a supporting portion 8*b* and a wiring groove 8*c*. The concave portion 8*a* is formed at the center of the end of the coil bobbin 8, and is latched on a rolling mechanism RM to be relatively rotatable. The supporting portion 8*b* is formed on a rear anchor of the coil bobbin 8, and is fixed to a fixing portion not shown. The wiring groove 8*c* is formed like a gutter on a part of the outer face of the coil bobbin 8 along the axial direction, and accommodates the feeding leads 9 inside. As shown in FIG. 3, the feeding leads 9 are accommodated in the wiring groove 8*c*, and are led to the outside from the rear anchor side of the coil bobbin 8 to be connected via a coaxial cable to the output terminals of the high frequency power supply HFS.

The first and second induction coils IC1, IC3 and IC2 are used in a static state, and the feeding leads 9 are accommodated in the wiring groove 8*c* to be close to the induction coils IC1, IC3 and IC2 so that, as there is little interlinking flux, the eddy current loss hardly occurs in the feeding leads 9.

The first and second induction coils IC1, IC3 and IC2 are inserted inside the heating roller HR from a ring portion 3*d* of a second end portion member 3B, where a concave portion 8*a* formed at the end of a coil bobbin 8 is latched on a tip portion 3*c* of a first end plate 3A, and a supporting portion 8*b* formed on the rear anchor as previously mentioned is fixed to the fixing portion so as to be supported in a coaxial relationship with the heating roller HR and maintain the static state even if the heating roller HR rotates.

<For High Frequency Power Supply HFS>

Figure 1:
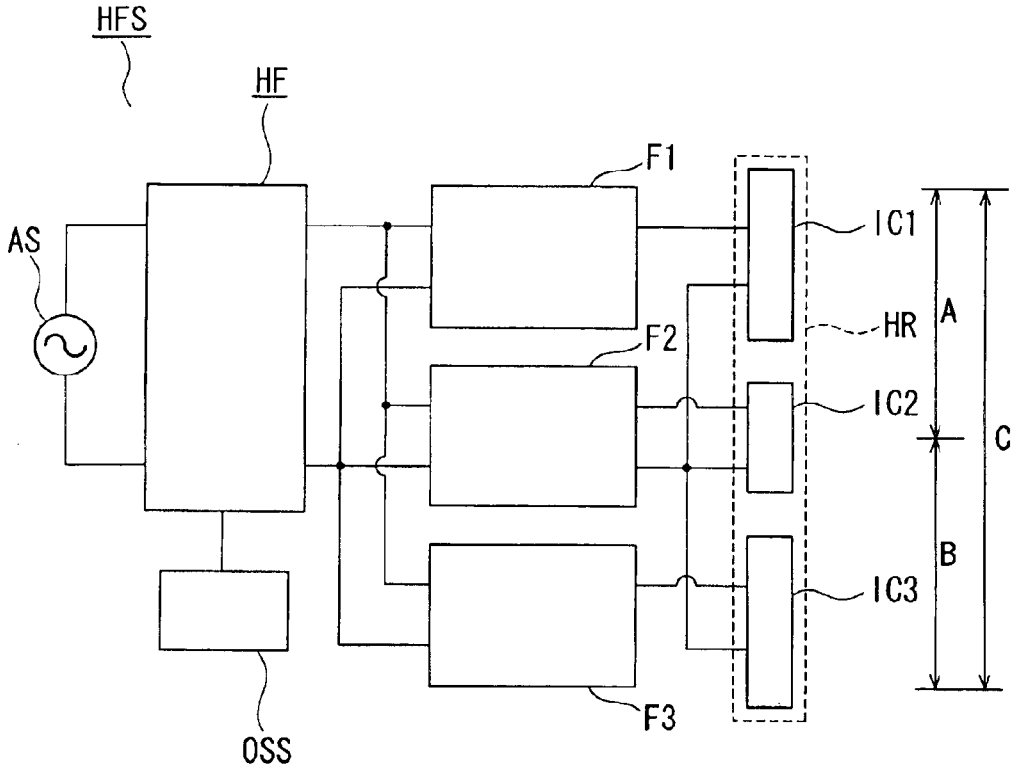
FIG. 1 is a schematic circuit block diagram showing an induction heating roller apparatus showing a first embodiment of the present invention.

As shown in FIG. 4, the high frequency power supply HFS is comprised of a low frequency power supply AS, a direct current power supply RDC, a high frequency generating portion HFI and a matching circuit MC. In FIG. 1, a reference symbol HF denotes an aggregation of the direct current power supply RDC, high frequency generating portion HFI and matching circuit MC thereof.

The low frequency AC power source is formed by, for example, a 100V commercial AC power source.

The DC power source DC is a rectifying circuit and has an input terminal, which is connected to the low frequency AC power source AS. The DC power source DC converts the low frequency AC voltage to a non-smoothened DC voltage, which is output from the DC output terminal of the DC power source DC.

The high frequency generating portion HFI is comprised of a high frequency filter HFF, a high frequency oscillator in a frequency variable form OSC, a drive circuit DC, a half-bridge inverter main circuit HBI, a load circuit LC, and an external signal source OSS (shown in FIG. 1). The high frequency filter HFF is comprised of a pair of inductors L1, L2 serial to both the lines and a pair of capacitors C1, C2 connected between the lines before and after the pair of inductors L1, L2, and intervenes between the DC power supply RDC and the half-bridge inverter main circuit HBI described later so as to keep the high frequency from flowing out to the low frequency AC power supply AS side. The high frequency oscillator OSC varies the oscillation frequency and is controlled by an external signal source OSS described below to generate a high frequency signal with variable frequency and sends the high frequency signal to the drive circuit DC. The drive circuit DC, which is a preamplifier, amplifies the high frequency signal sent from the high frequency oscillator OSC to output the drive signal. The half-bridge inverter main circuit HBI includes two MOSFETs Q1, Q2, which are connected in series between the output terminals of the DC power supply RDC, and two capacitors C3, C4, which are connected parallel to the MOSFETs Q1, Q2. The MOSFETs Q1, Q2 are alternately switched by drive signals of a drive circuit DC. The halt-main bridge inverter main circuit HBI converts the DC output of the DC power supply RDC to a high frequency having a substantially rectangular wave. The capacitors C3, C4 function as a high frequency bypass when inverting is being performed. The load circuit LC includes a DC cut capacitor C5, an inductor L3 and a matching circuit MC described below. The DC Cut capacitor C5 prevents a DC component from flowing to the load circuit LC from the DC power supply DC side via the MOSFETs Q1, Q2. The inductor L3 and the matching circuit MC form a series resonance circuit and waveform shape the high frequency voltage applied across the first and second induction coils IC1 and IC2. The waveform shaped high frequency voltage biases the first and second induction coils IC1, IC3 and IC2. The external signal source OSS varies the output frequency of the high frequency power supply HFS and controls the oscillator OSC to vary the oscillation frequency of the oscillator OSC according to the heating range selected by operation.

As shown in FIG. 4, the matching circuit MC is an impedance conversion circuit comprised of a capacitor C6 serial to a high frequency output line and a capacitor C7 parallel therewith, and is placed close to the high frequency generating portion HFI. And it matches impedances of loads seen from the high frequency generating portion HFI and matching circuit MC so as to increase the power transmission efficiency.

<For Induction Coil Selection Means F1, F2 and F3>

Figure 5:
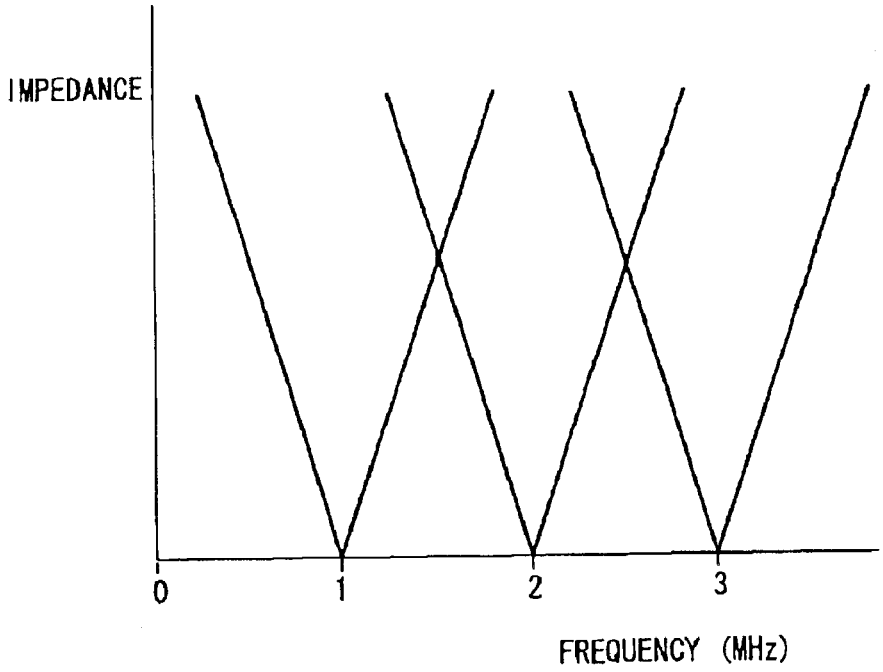
FIG. 5 is likewise a graph showing a filter characteristic of induction coil selection means.

The induction coil selection means F1, F2 and F3 are comprised of band-pass filters of which pass bands are mutually different. As shown in FIG. 5, for the irrespective pass bands, for instance, the induction coil selection means F1 is 1 MHz, the induction coil selection means F2 is 2 MHz, and the induction coil selection means F3 is 3 MHz. And the induction coil selection means F1 serially intervenes between the high frequency power supply HFS and the first induction coil group IC1. The induction coil selection means F2 is connected likewise to the second induction coil group IC2. In addition, the induction coil selection means P3 is connected likewise to the third induction coil group IC3.

<For Operation of the Induction Heating Roller Apparatus>

The low frequency AC voltage of the low frequency AC power supply AS is converted into a DC voltage by the DC power supply RDC, is further converted into a high frequency voltage by the high frequency power supply HFS, and is further applied selectively to the first induction coils IC1 and IC3, and a second induction coil IC2 in a standing-still state by way of the induction coil selection means F1, F2 and F3.

If the external signal source OSS is operated to cyclically switch the frequency of the high frequency output of the high frequency power supply HFS to 1 MHz and 2 MHz alternately at a low frequency of 10 Hz for instance, the induction coil selection means F1 passes 1 MHz so that, when the high frequency power supply HFS is outputting 1 MHz, the first induction coil group IC1 is energized in a time-shared manner. In addition, when the high frequency power supply HFS is outputting 2 MHz, the second induction coil group IC2 is energized in a time-shared manner. For that reason, the first induction coil group IC1 and the second induction coil group IC2 are air-core-transfer-coupled to the secondary coil ws of the heating area A of the heating roller HR facing it, so that a secondary current is induced to the secondary coil we in ago-around direction of the heating roller HR. Consequently, a resistance R of the secondary coil ws generates Joule heat. In that case, in FIG. 1, the part of the heating roller HR opposed to the upper ends of the first induction coils IC1 and the lower ends of the second induction coils IC2 generates the temperature gradient.

Figure 6:
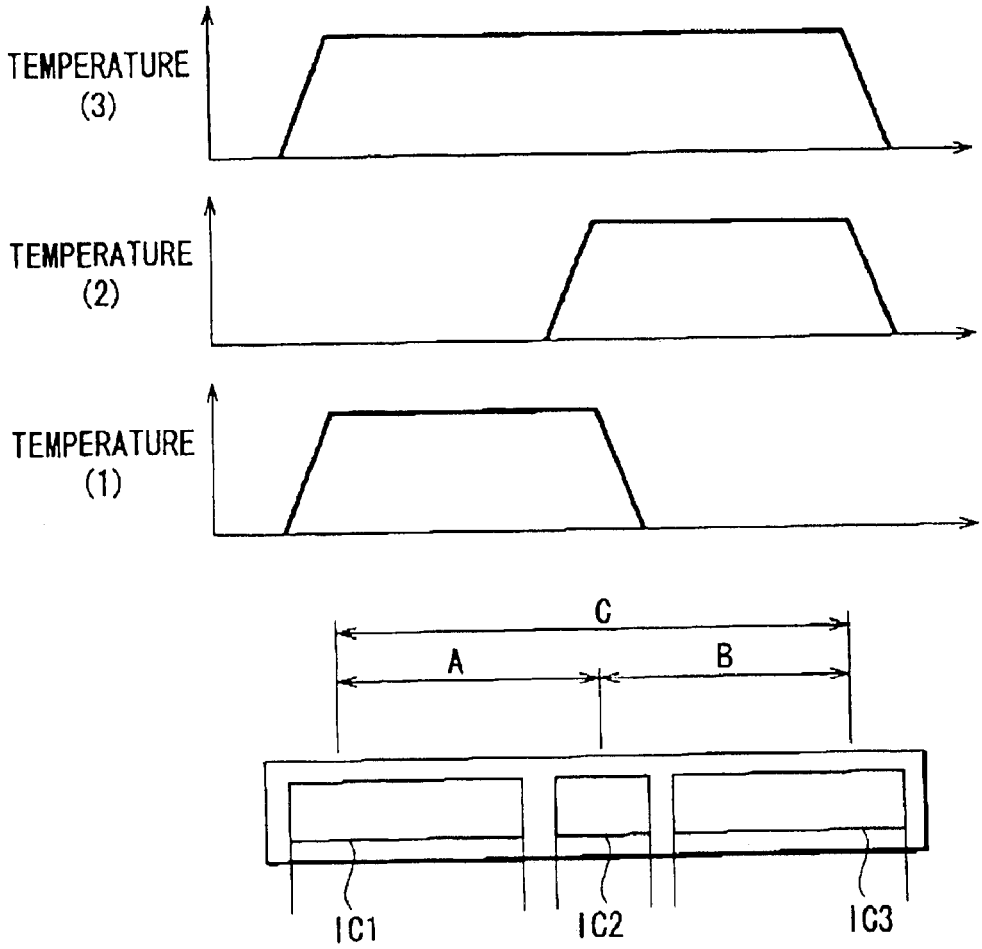
FIG. 6 is likewise a conceptual diagram for explaining a relationship between switching of a heating area of the heating roller and temperature distribution of the heating roller.

However, the induction coils IC1 and IC2 opposed to the heating area A are in the central parts respectively, and so the heating area A is evenly heated as shown in FIG. 6 (1).

As opposed to this, if the external signal source OSS is operated to cyclically switch the frequency of the high frequency output of the high frequency power supply HFS to 2 MHz and 3 MHz alternately at a low frequency of 10 Hz for instance, the induction coil selection means F2 and F3 pass the high frequency powers of their respective pass frequencies so that the first, second and third induction coil groups IC1, IC2 and IC3 are mutually energized in a time-shared manner. As a result, it works as in the above description, and the heating areas B of the heating roller HR are evenly heated as shown in FIG. 6 (2).

Furthermore, if the external signal source OSS is manipulated to cyclically switch the frequency of the high frequency output of the high frequency power supply HFS to 1 MHz, 2 MHz and 3 MHz at a low frequency of 10 Hz for instance, the induction coil selection means F1, F2 and F3 pass the high frequency power of their respective pass frequencies so that the first induction coils IC1 and IC3 and second induction coil IC2 are sequentially energized in a time-shared manner. As a result, it works as in the above description, and the heating area C which is the sum of the heating areas A and B of the heating roller HR is evenly heated as shown in FIG. 6 (3).

Next, second to fourth embodiments according to the present invention will be described by referring to FIGS. 7 to 9. In the drawings, the same portions as in FIG. 1 are given the same symbols, and description thereof will be omitted.

Figure 7:
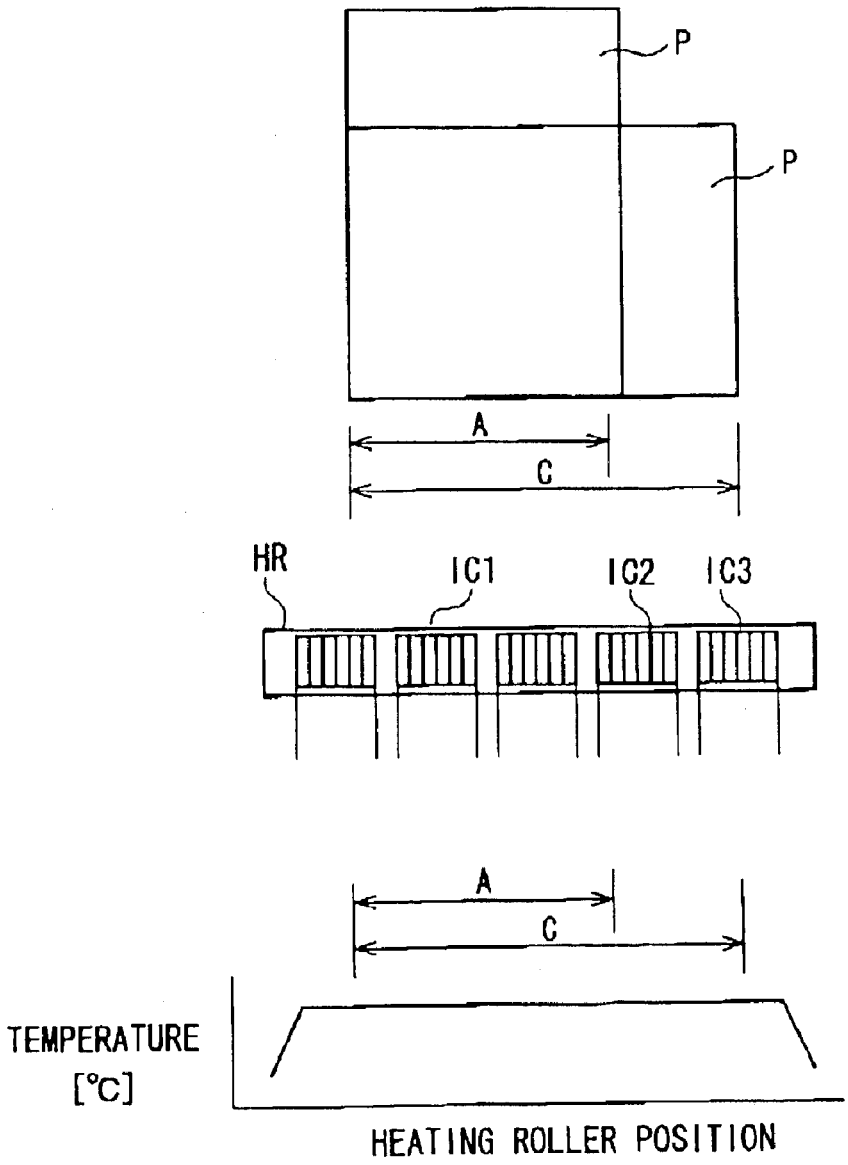
FIG. 7 is a conceptual diagram for explaining a relationship among change of a size of an object to be heated, placement of first and second induction coils and the temperature distribution of the heating roller according to a second embodiment of the induction heating roller apparatus of the present invention.

As shown in a conceptual diagram drawn in the middle portion of FIG. 7, the second embodiment of the induction heating roller apparatus according to the present invention is comprised of five coil elements of which first and second induction coils are of the same specifications (coil length, coil pitch and coil diameter), and the first induction coil IC1 is constituted by connecting three coil elements in parallel to the high frequency power supply. And the first induction coil IC3 and second induction coil IC2 are comprised of one coil element respectively. The heating roller HR is constituted so that the heating areas A and C are switchable. Furthermore, an object to be fixed P has the same width as the heating area A in a vertical position and the same size as the heating area C in a horizontal position.

And if the first and second induction coils IC1 and IC2 are simultaneously energized, the heating area A is evenly heated as shown at the bottom of FIG. 7. Therefore, as shown at the top of FIG. 7, it is possible to heat and fix the object to be heated P comprised of paper forming the toner image while passing it through the heating area A of the heating roller HR in the vertical position. In addition, if the first induction coils IC1 and IC3 and second induction coil IC2 are simultaneously energized, the heating area C is evenly heated. Therefore, it is possible to heat and fix the object to be heated P comprised of the paper forming the toner image while passing it through the heating area C of the heating roller HR in the horizontal position.

Figure 8:
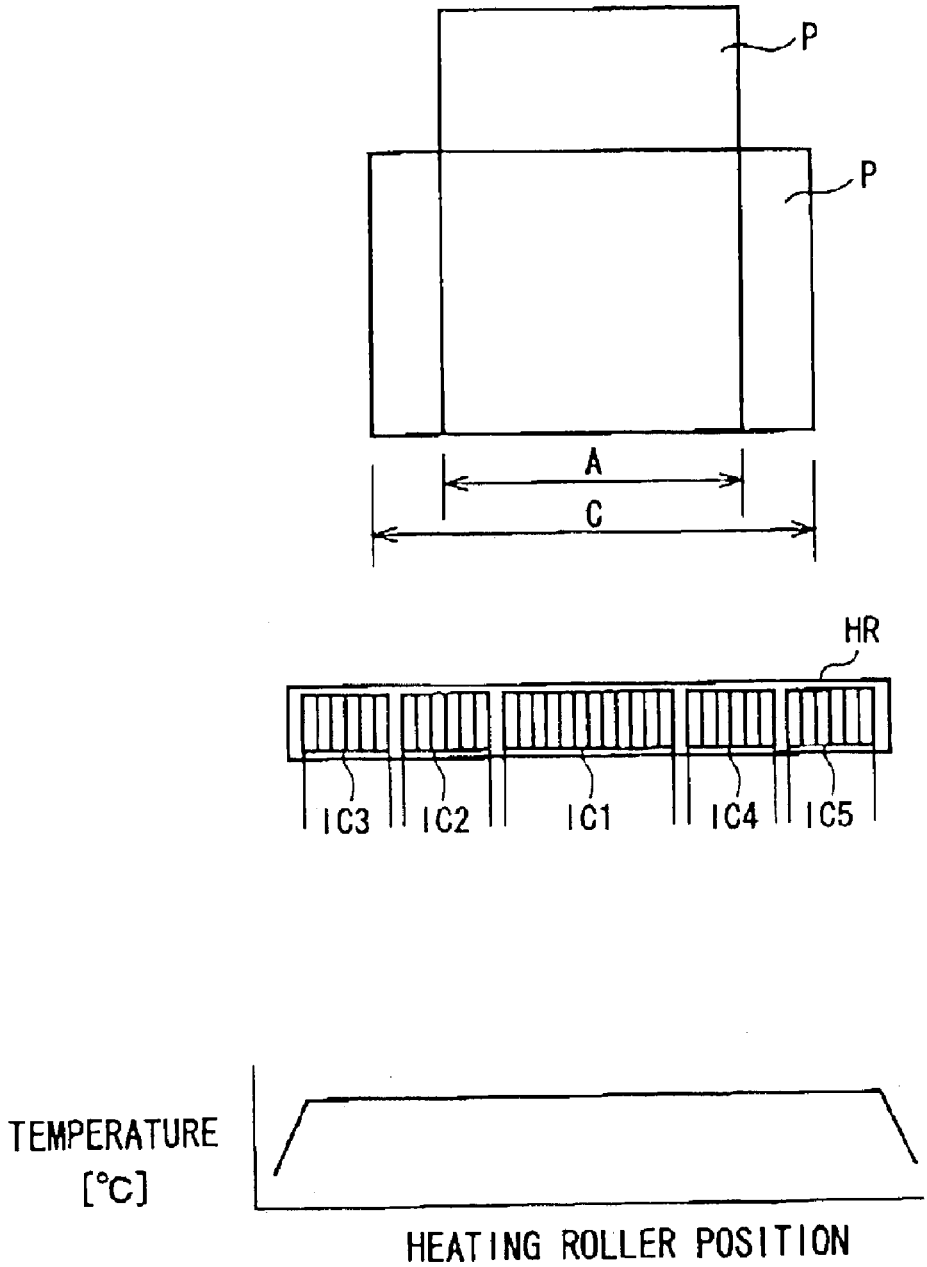
FIG. 8 is a conceptual diagram for explaining the relationship among the change of the size of the object to be heated, the placement of first and second induction coils and the temperature distribution of the heating roller according to a third embodiment of the induction heating roller apparatus of the present invention.

As shown in the middle portion of FIG. 8, the third embodiment of the induction heating roller apparatus according to the present invention has the first induction coils comprised of IC1, IC3 and IC5. And the first induction coils IC3 and IC5 are separately arranged on both sides of IC1, and have half the length of IC1. On the other hand, the second induction coils are comprised of IC2 and IC4. And the second induction coil IC2 is placed between the first induction coils IC1 and IC3. In addition, the second induction coil IC4 is placed between the first induction coils IC1 and IC5.

And if the first induction coil IC1 and second induction coils IC2 and IC4 are simultaneously energized, the heating area A is evenly heated as shown at the top of FIG. 8. Therefore, it is possible to heat and fix the object to be heated P comprised of the paper forming the toner image while passing it through the heating area A formed at the center of the heating roller HR in the vertical position.

In addition, if the first induction coils IC1, IC3 and IC5 and second induction coils IC2 and IC4 are simuiltaneously energized, the long heating area C formed at the center of the heating roller HR is evenly heated as shown at the top and bottom of FIG. 8 respectively. Therefore, as shown at the top of FIG. 7, it is possible to heat and fix the object to be heated P comprised of the paper forming the toner image while passing it through the heating area C of the heating roller HR in the horizontal position.

Figure 9:
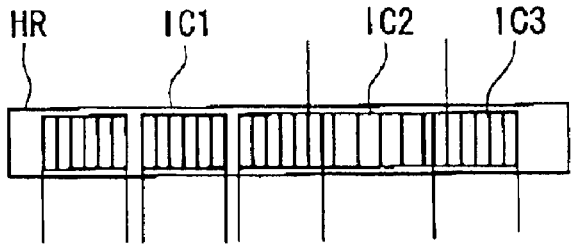
FIG. 9 is a layout plan of the induction coils conceptually showing a configuration of the first and second induction coils according to a fourth embodiment of the induction heating roller apparatus of the present invention.

As shown in FIG. 9, the fourth embodiment of the induction heating roller apparatus according to the present invention has the second induction coil IC2 overlapping the pair of adjacent first induction coils IC1, IC3 on both ends in the axial direction. The second induction coil IC2 has a relatively rough coil pitch so that a heating amount of the opposed heating roller HR is limited.

Furthermore, the fifth and sixth embodiments according to the present invention will be described by referring to FIGS. 10 and 11. In the drawings, the same portions as in FIG. 6 are given the same symbols, and description thereof will be omitted.

Figure 10:
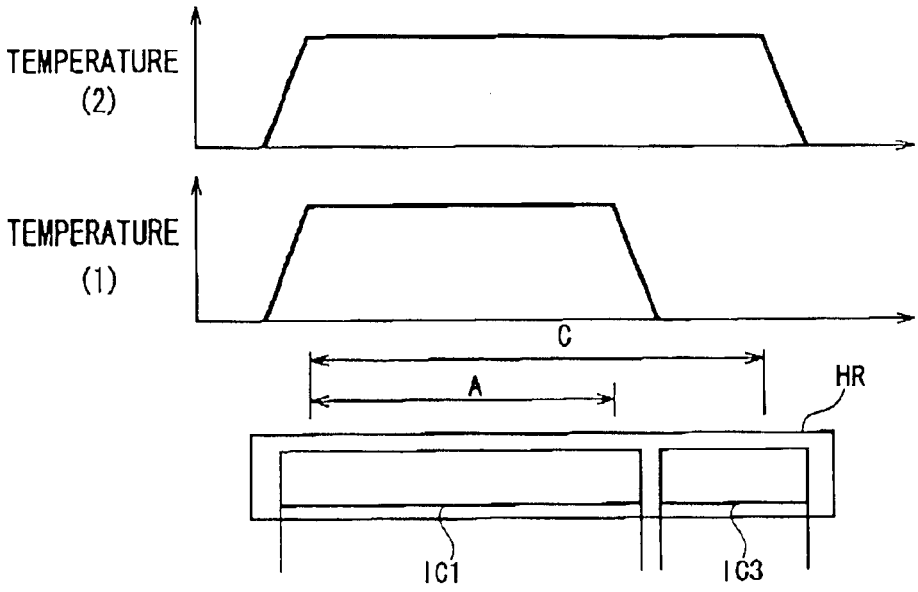
FIG. 10 is a conceptual diagram showing the induction coils and the temperature distribution of the heating roller according to a fifth embodiment of the induction coil apparatus of the present invention.

As shown at the bottom of FIG. 10, the fifth embodiment of the induction coil apparatus according to the present invention has the induction coils comprised of the two first induction coils IC1 and IC3 opposed to the heating area of the heating roller. However, the first induction coil IC1 is formed to get out of both ends of the opposed heating area A. The induction coils IC1 and IC3 are formed to get out of both ends of the opposed heating area C.

Therefore, the temperature distribution of the heating area A of the heating roller HR becomes even as shown in (1) at the top of FIG. 10. Likewise, the temperature distribution of the heating area C also becomes even as shown in (2) at the top of FIG. 10.

Figure 11:
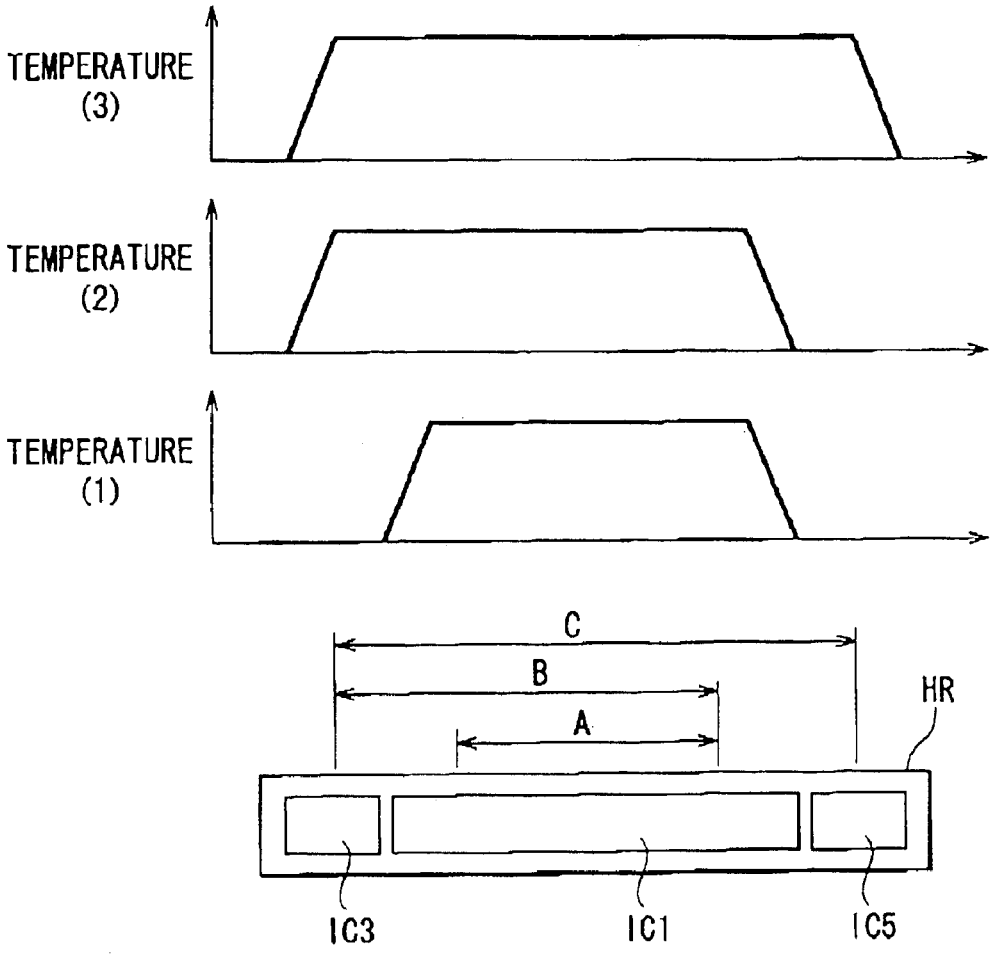
FIG. 11 is a conceptual diagram showing the induction coils and the temperature distribution of the heating roller according to a sixth embodiment of the induction coil apparatus of the present invention.

As shown at the bottom of FIG. 11, the sixth embodiment of the induction coil apparatus according to the present invention has the induction coils comprised of the three first induction coils IC1, IC3 and IC5 opposed to the heating area of the heating roller. However, the induction coil IC1 is formed to get out of both ends of the opposed heating area A. The induction coils IC1 and IC3 are formed to get out of both ends of the opposed heating area B. Furthermore, the induction coils IC1, IC3 and IC5 are formed to get out of both ends of the opposed heating area C.

Therefore, the temperature distribution of the heating areas A, B and C of the heating roller HR become even as shown in (1), (2) and (3) at the top of FIG. 11.

Figure 12:
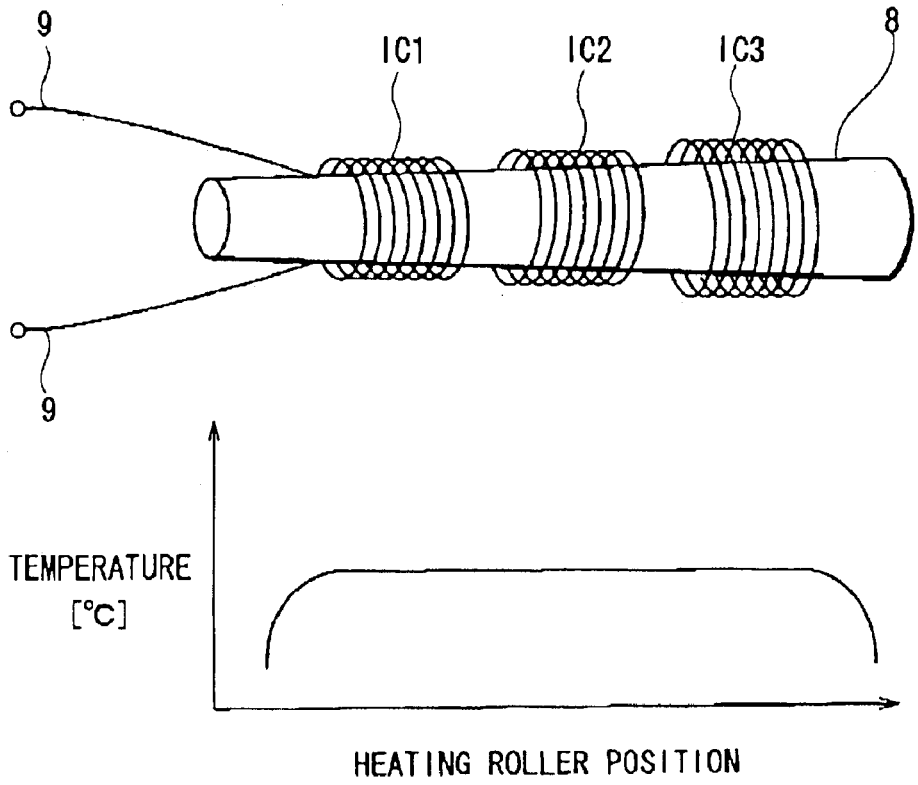
FIG. 12 is a conceptual perspective view showing the induction coils according to a seventh embodiment of the induction coil apparatus of the present invention.

As shown at the top of FIG. 12, the seventh embodiment of the induction coil apparatus according to the present invention is constituted to reduce influence of the heating amount due to a difference in length between the feeding leads 9, 9 on the induction coils. To be more specific, in the case where the three induction coils IC1, IC2 and IC3 are arranged separately in the axial direction of the coil bobbin 8 and connected in parallel to the pair of feeding leads 9, 9, the induction coil IC1 near the high frequency power supply and the induction coil IC3 farther therefrom are different in length of the feeding leads 9, 9 intervening between them and the high frequency power supply. If the feeding leads 9 are longer, influence of a distribution capacity of the feeding leads becomes stronger and the high frequency power is bypassed by the distribution capacity so that the high frequency power applied to the induction coil IC3 is reduced. Consequently, the temperature distribution of the heating roller is not constant.

Thus, the seventh embodiment has the configuration wherein, as the diameters of the induction coils meet the condition of IC1<IC2<IC3, that is, the farther from the high frequency power supply, the larger the coil diameter becomes so that the magnetic coupling of the heating roller becomes stronger To be more specific, the amount of the high frequency power reduced by the distribution capacity of the feeding leads 9, 9 is supplemented by reinforcing the magnetic coupling of the induction coils. Consequently, the temperature distribution in the axial direction of the heating roller becomes constant as shown at the bottom of FIG. 12.

As shown in FIG. 8, the eighth embodiment of the induction heating roller apparatus according to the present invention has the induction coil selection means suitable for selectively switching the induction coils when selectively energizing the plurality of induction coils with the frequency-variable high frequency power supply in common. As for the heating roller and frequency-variable high frequency power supply, the configurations according to the first embodiment of the present invention shown in FIGS. 1 to 6 are adopted.

Figure 14:
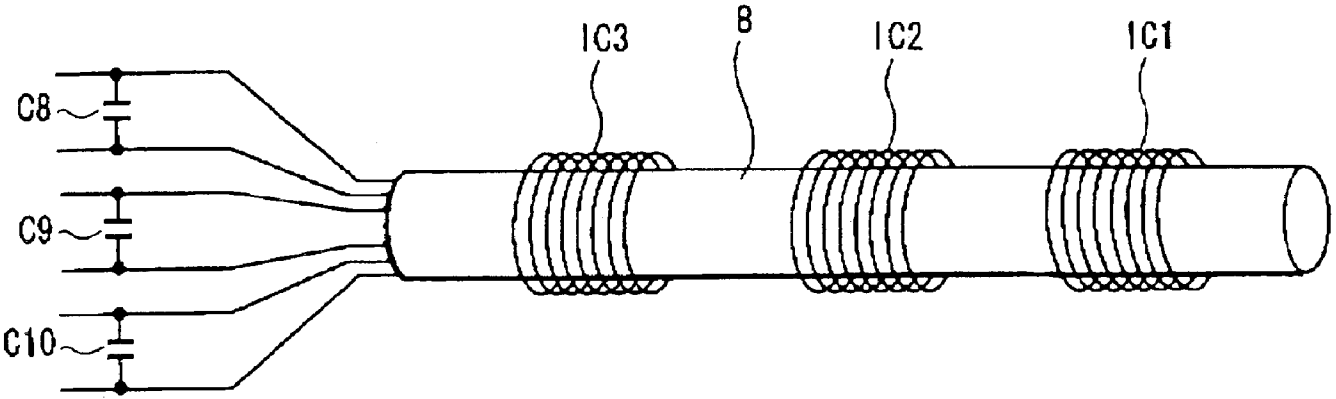
FIG. 14 is likewise a perspective view of the induction coils.

To be more specific, the induction coils are the first to third induction coils IC1, IC2 and IC3 for instance, which are arranged separately in the axial direction of the heating roller HR as shown in FIG. 14. In other words, the second induction coil IC2 is positioned in the central area of the heating roller, and the first and third induction coils IC1, IC2 are positioned at both end areas of the heating roller HR.

Figure 13:
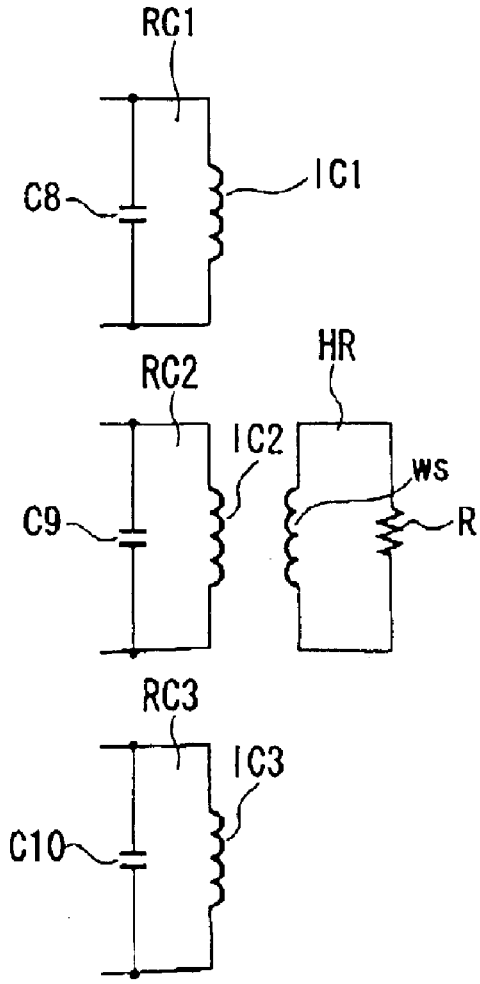
FIG. 13 is a circuit diagram of a relevant part according to an eighth embodiment of the induction heating roller apparatus of the present invention.

The induction coil selection means is comprised of first to third resonance circuits RC1, RC2 and RC3. As shown in FIG. 13, the first to third resonance circuits RC1, RC2 and RC3 are formed with the inductances and resistances of the induction coils IC1, IC2 and IC3 and the capacitors C8, C9 and C10 connected in parallel to the induction coils IC1, IC2 and IC3. Therefore, the resonance circuits RC1, RC2 and RC3 constitute parallel resonance circuits.

Figure 15:
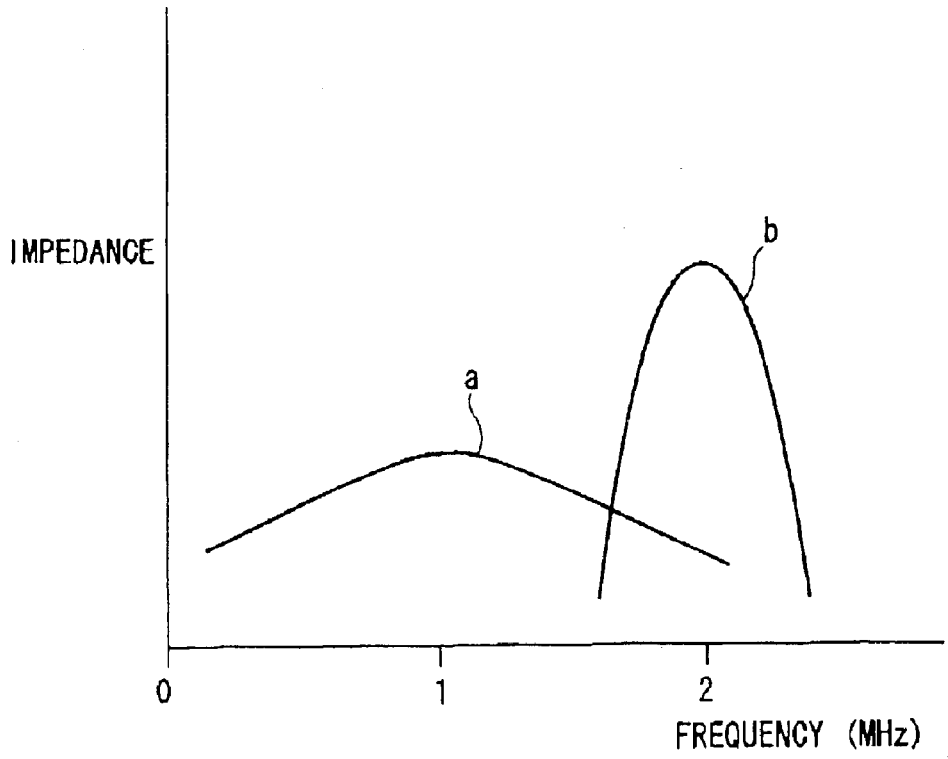
FIG. 15 is likewise a graph showing resonance characteristics of two resonance circuits.

In addition; the first to third resonance circuits RC1, RC2 and RC3 have different resonance frequencies and values Q. As shown by a resonance characteristic curve a in FIG. 15, the first resonance circuit RC1 has a resonance frequency of 1 MHz for instance, and Q is set to be small. As shown by a resonance characteristic curve b in FIG. 15, the second resonance circuit RC2 has the resonance frequency of 2 MHz, and Q is set to be large. Although it is not shown in FIG. 15, the third resonance circuit RC3 has the resonance frequency of 3 MHz, and Q is set to be small.

Furthermore, the respective capacitors C8, C9 and C10 of the resonance circuits RC1, RC2 and RC3 are collectively placed outside the coil bobbin 8 as shown in FIG. 14.

According to the eighth embodiment of the present invention, if the output frequency of the frequency-variable high frequency power supply is 2 MHz, the second resonance circuit RC2 resonates and its impedance becomes maximum, and so a terminal voltage of the induction coils IC2 becomes maximum so that the high frequency power supplied from the frequency-variable high frequency power supply is intensively applied to the second induction coil IC2. Consequently, as for the heating roller, the secondary currents due to the air-core transfer coupling are intensively induced to the central area opposed to the second induction coil IC2, and thus the area is heated.

As opposed to this, as for the first and third induction coils IC1, IC3 positioned at both the end areas of the heating roller HR, Q of their resonance circuit is small and selectivity is weak, and so some selectivity is exhibited to the above output frequency so that, even if low, a high frequency voltage is applied to the first and third induction coils IC1, IC3. Consequently, both the end areas of the heating roller HR opposed to the first and third induction coils IC1, IC3 are heated somewhat and maintained in a preheated state.

Figure 16:
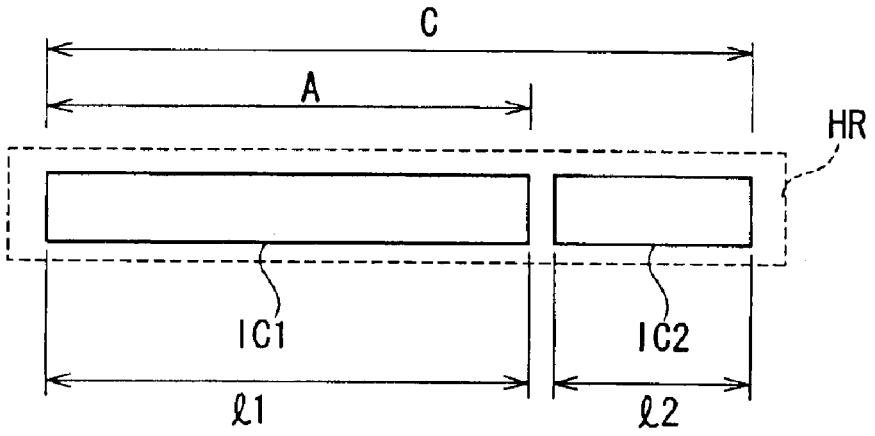
FIG. 16 is a diagram for explaining the relevant part showing a ninth embodiment of the induction heating roller apparatus of the present invention.

As shown in FIG. 16, the ninth embodiment of the induction heating roller apparatus according to the present invention has the configuration suited to heating the induction coils of different lengths such as the first and second induction coils IC1, IC2, for instance, at the same temperature. Otherwise, the induction heating roller apparatus has the same configuration as the first embodiment shown in FIGS. 1 to 6. However, it may also have the same configuration as the eighth embodiment shown in FIGS. 13 and 14.

To be more specific, the length of the first induction coils IC1 in the axial direction is l1 and that of the second induction coil IC2 is l2. And their relationship is l1>l2. The high frequency power is supplied to the first and second induction coils IC1, IC2 from the high frequency power supply by first and second filter means while alternately switching between them. In that case, if time for supplying the high frequency power to the first induction coil IC1 is T1, and the time for supplying it to the second induction coil IC2 is T2, it is T1>T2 and the ratio is almost in proportion to l1:l2. Thus, almost the entire length area C in the axial direction of the heating roller HR is heated at an even temperature. The supply of the high frequency power to the first and second induction coils IC1, IC2 while alternately switching between them is performed by PWM control at a low frequency for instance.

Next, it is possible, by supplying the high frequency power only to the first induction coil IC1, to locally heat only the heating area A of the heating roller HR.

Figure 17:
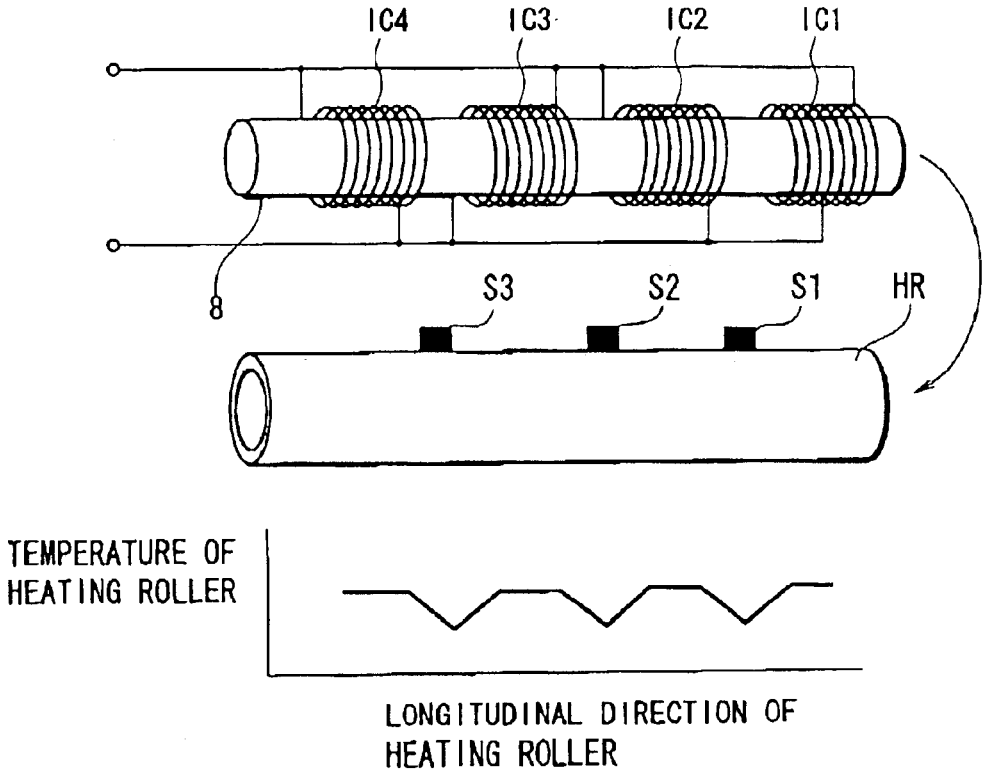
FIG. 17 is a conceptual diagram catabolically showing the relevant part according to a tenth embodiment of the induction heating roller apparatus of the present invention and also showing the temperature distribution of the heating roller in an axial direction.

As shown in FIG. 17, the tenth embodiment of the induction heating roller apparatus according to the present invention has the configuration suited to performing a protected operation against an abnormality of the heating roller. To be more specific, the induction coils such as four induction coils IC1, IC2, IC3 and IC4 are arranged separately in the axial direction of the heating roller HR. And the adjacent induction coils have mutually inverse winding directions. Although it is not shown, the induction coils IC1, IC2, IC3 and IC4 are constituted to switch by having the output frequency of the frequency-variable high frequency power supply changed by the filter means.

A plurality of thermistors S1, S2 and S3 are placed in a slidable relationship with the surface of the heating roller HR in the part opposed to the pair of adjacent induction coils of the heating roller HR. And the thermistors S1, S2 and S3 are constituted to control-input the temperature of the slidable part of the heating roller HR to a protection circuit not shown.

Next, to describe a circuit operation, if the high frequency power is supplied to the pair of adjacent induction coils such as IC1 and IC2 for instance, the directions of the magnetic fields generated by the induction coils IC1 and IC2 respectively become mutually inverted. Consequently, magnetic field strength between the induction coils IC1 and IC2 is offset and the heating roller becomes smaller. For this reason, the temperature of the position at which the thermistor S1 of the heating roller HR is placed becomes lower, and the thermistor S1 detects the temperature. As the temperature detected by the thermistor S1 is control-inputted to the protection circuit not shown, it is possible to perform the protected operation against incomplete switching or switching abnormality of the heating area.

Figure 18:
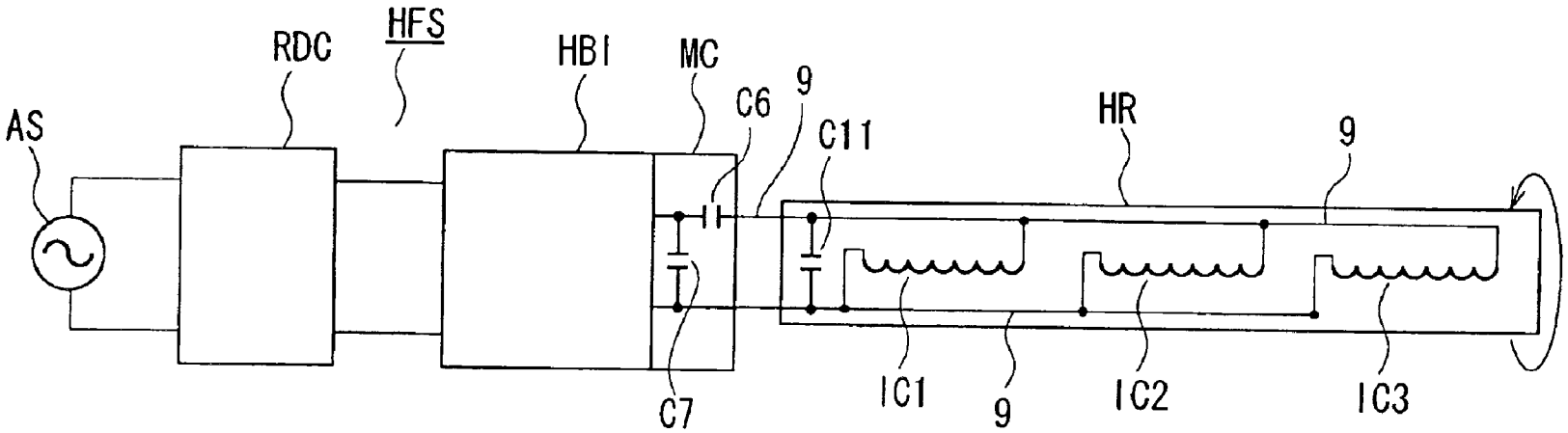
FIG. 18 is a circuit block diagram for conceptually explaining an eleventh embodiment of the induction heating roller apparatus according to the present invention.
Figure 19:
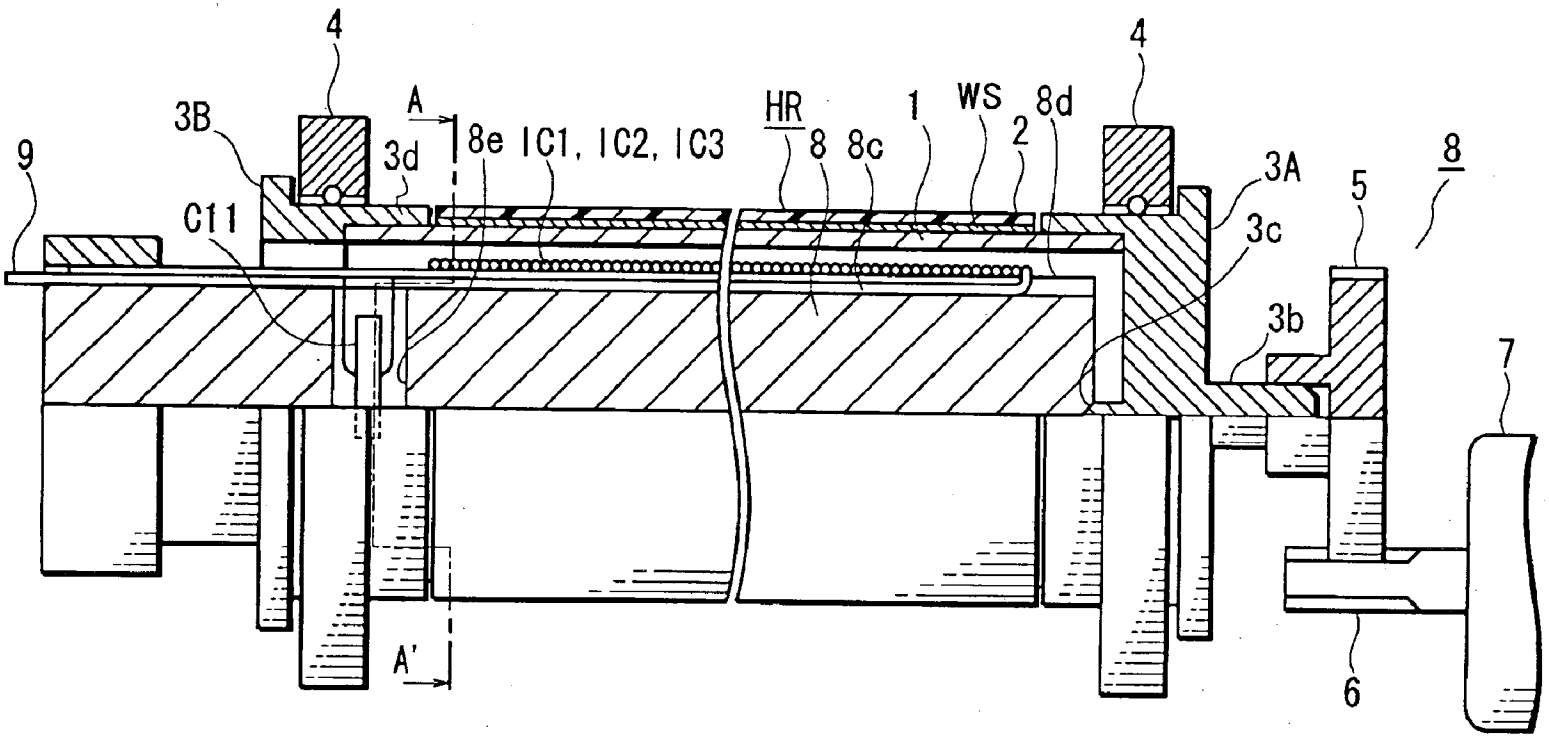
FIG. 19 is likewise a partially notched longitudinal sectional front view of the center.
Figure 20:
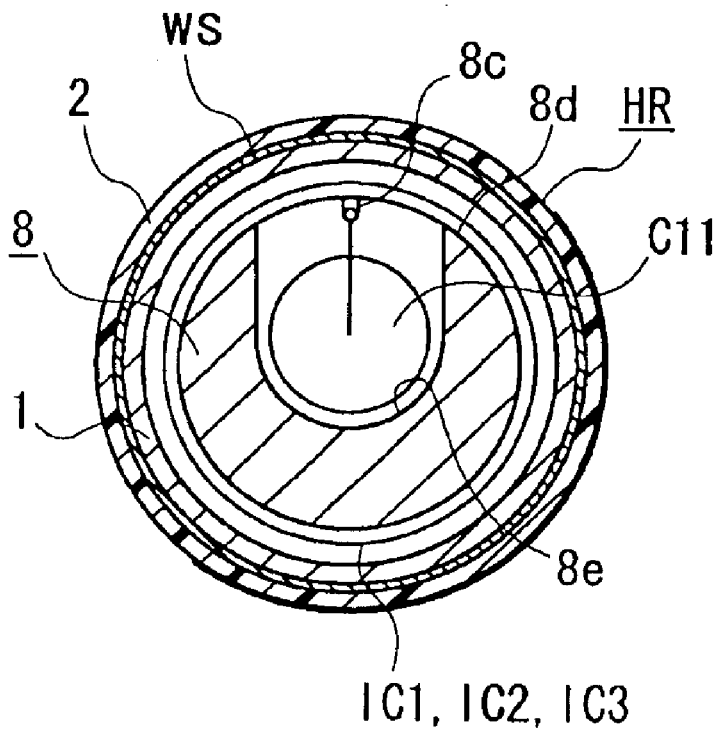
FIG. 20 is likewise a sectional view along a line A to A' in FIG. 19.

As shown in FIGS. 18 to 20, according to the eleventh embodiment of the present invention, the three induction coils IC1, IC2 and IC3 of the induction heating roller apparatus have power factor improvement means C11, and a high frequency-transmission line 9 and a matching circuit MC intervene between a high frequency power supply HFS and the induction coils IC1, IC2 and IC3.

The three induction coils IC1, IC2 and IC3 are wound around the coil bobbin 8 separately in its axial direction, and are connected in parallel to a termination of the high frequency transmission line 9 described later. In addition, as shown in FIG. 19, the induction coils IC1, IC2 and IC3 are connected in parallel between the high frequency transmission lines 9, 9.

The coil bobbin 8 has a winding groove 8*d* for regularly winding induction coils IC1, IC2 and IC3 a wiring groove 8*b* extended on a part of the rim in the axial direction and a concave portion 8*e* opening in the wiring groove 8*c* on the rim.

The power factor improvement means C11 is comprised of the ceramic capacitor. And as shown in FIG. 18, it is connected in parallel to the three induction coils IC1, IC2 and IC3 at the termination of the high frequency transmission line 9 described later. As shown in FIGS. 19 and 20, it is accommodated in the concave portion 8*c* of the coil bobbin 8.

The high frequency transmission lines 9,9 are two parallel lines, and connect the matching circuit MC described later and the induction coils IC1, 102 and IC3. The high frequency power supply HFS and the matching circuit MC are placed clear of the induction coils IC1, IC2 and IC3 so as to avoid thermal interference.

The matching circuit MC is an impedance conversion circuit comprised of a capacitor C6 in series to the high frequency transmission line 9 and a capacitor C5 parallel thereto, and balances, an internal impedance of the high frequency power supply HFI against the impedance on the load side seen from the beginning of the high frequency transmission line 9.

As the power factor improvement means C11 is connected in parallel to the termination of the high frequency transmission line 9 in addition to the three induction coils IC1, IC2 and IC3 in the static state, the power factor of the high frequency current running in the high frequency transmission line 9 becomes higher so that, even if the high frequency power supplied to the three induction coils IC1, IC2 and IC3 is equal, the high frequency current running in the high frequency transmission line 9 becomes lower.

Figure 21:
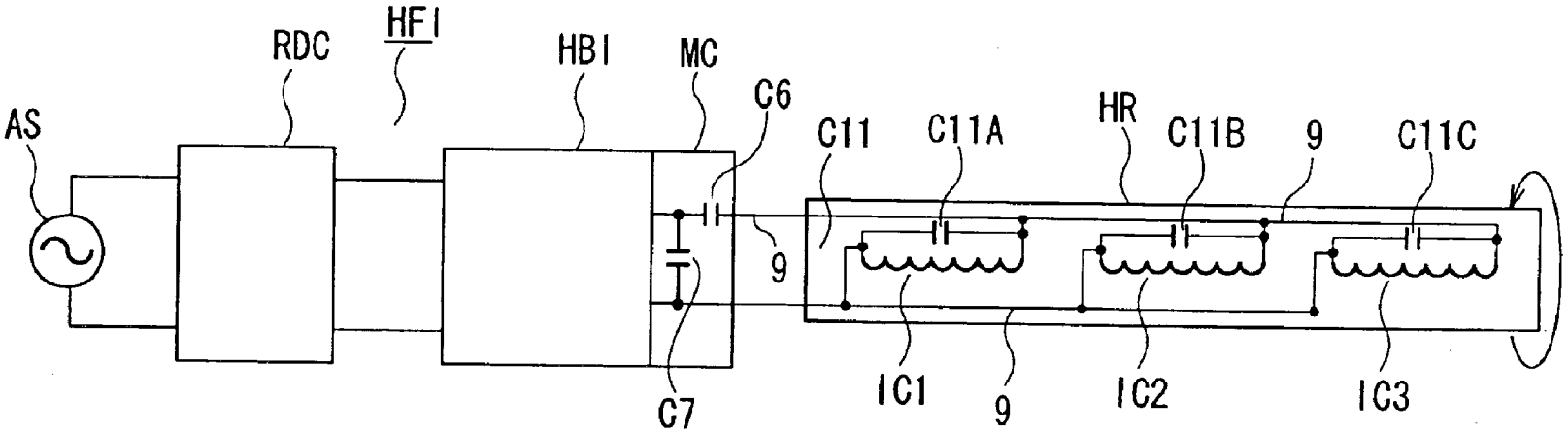
FIG. 21 is a circuit block diagram for conceptually explaining a twelfth embodiment of the induction heating roller apparatus according to the present invention.

As shown in FIG. 21, the twelfth embodiment of the induction heating roller apparatus according to the present invention has power factor improvement means C11A, C11B and C11C thus divided into three to be corresponding to the induction coils IC1, IC2 and IC3 and placed close to the corresponding induction coils respectively.

Figure 22:
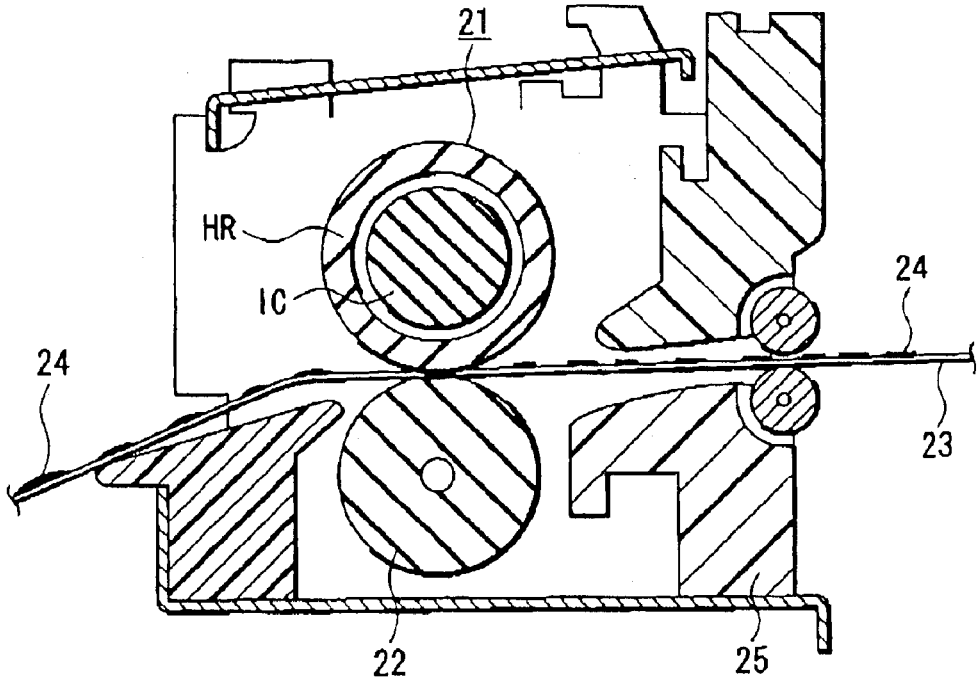
FIG. 22 is a longitudinal section showing an embodiment of a fixing apparatus according to the present invention.

FIG. 22 shows an embodiment of the fixing apparatus according to the present invention. In the drawing, reference numeral 21 denotes the induction heating roller apparatus, 22 denotes the pressing roller, 23 denotes the recording medium, 24 denotes the toner, 25 denotes a mount and reference symbol IC denotes the induction coil.

The induction heating roller apparatus 21 may be any of the first to twelfth embodiments of the induction heating roller apparatus shown in FIGS. 1 to 21.

The pressing roller 22 is placed in a pressure welding relationship with the heating roller HR of the induction heating roller apparatus 21, and carries a record medium 23 tightly sandwiched between them.

The record medium 23 has the image formed by having a toner 24 adhered on the surface thereof.

The mount 25 has the above components (except the record medium 23) installed in a predetermined positional relationship.

And as for the fixing apparatus, the record medium 23 having the toner 24 adhered thereon and the image formed is inserted between the heating roller HR of the induction heating roller apparatus 21 and the pressing roller 22 to be carried, and the toner 24 is heated and melted by receiving heat of the heating roller HR so that heat fixing is performed.

Figure 23:
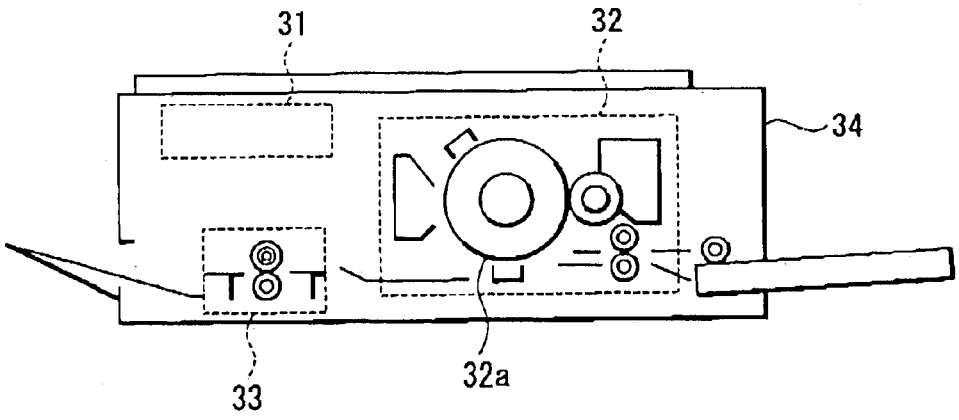
FIG. 23 is a schematic cross-sectional of a copy machine serving as an image formation apparatus according to the present invention.

An embodiment of the image formation apparatus according to the present invention is a copying machine as shown in FIG. 23. In FIG. 23, reference numeral 31 denotes a reader, 32 denotes image formation means, 33 denotes a fixing apparatus and 34 denotes an image formation apparatus case.

The reader 31 forms an image signal by optically reading an original sheet of paper.

The image formation means 32 forms an electrostatic latent image on a photosensitive drum 32*a* based on the image signal, and adheres toner to this electrostatic latent image to form a reverse image which is printed on a record medium such as paper so as to form the image.

The fixing apparatus 33 has a construction shown in FIG. 22 and heats and melts the toner adhered to the recording medium to be thermally fixed.

The image formation apparatus case 34 accommodates the above apparatuses and the means 31 to 33, and is also equipped with a carrying apparatus, a power supply apparatus, a control apparatus and so on.

We claim:

1. An induction heating roller apparatus wherein:

a heating roller for magnetically coupling to induction coils, generating heat with an induction current, and switching among a plurality of heating areas of different lengths according to a size of an object to be heated;

a plurality of first induction coils arranged separately in an axial direction of the heating roller and also arranged to be opposed to a plurality of heating areas of the heating roller;

second induction coils placed opposite a part astride adjacent heating areas of the heating roller;

a high frequency power supply for supplying high frequency power to the first and second induction coils; and induction coil selection means for, by intervening between the high frequency power supply and induction coils, selectively supplying high frequency output of the high frequency power supply to the first induction coils and the second induction coils.

2. The induction heating roller apparatus according to claim 1, wherein the second induction coils are placed between the first induction coils opposed to adjacent heating areas of the heating roller.

3. The induction heating roller apparatus according to claim 1, wherein the second induction coils are placed with both ends overlapping the first induction coils opposed to the adjacent heating areas of the heating roller.

4. The induction heating roller apparatus according to claim 1, wherein the high frequency power supply is a frequency-variable high frequency power supply capable of feeding power to the plurality of first and second induction coils in common and having a variable output frequency; and the induction coil selection means includes filter means for intervening between the frequency-variable high frequency power supply and the induction coils and controlling the high frequency power by selectively operating according to the frequencies.

5. The induction heating roller apparatus according to claim 1, wherein the high frequency power supply is a frequency-variable high frequency power supply capable of feeding the power to the plurality of first induction coils in common and having a variable output frequency; and wherein the induction coil selection means includes a plurality of resonance circuits which intervene between the frequency-variable high frequency power supply and the induction coils, and the induction coils are resonance circuit elements and have resonance frequencies and Q values of different sizes.

6. The induction heating roller apparatus according to claim 1, wherein a pair of adjacent induction coils are adjacent in a state of different winding directions.

7. The induction heating roller apparatus according to claim 1, further comprising:

a high frequency transmission line for connecting the high frequency power supply and the induction coils;

power factor improvement means coupled to the first and second induction coils and placed at a position close to the induction coils for increasing a power factor of high frequency current running in the high frequency transmission line; and a matching circuit intervening between the high frequency power supply and the high frequency transmission line and placed close to the high frequency power supply.

8. The induction heating roller apparatus according to claim 7, further comprising:

a coil bobbin supporting the first and second induction coils on a rim side and having a concave portion at least partially formed thereon; and wherein the power factor improvement means is accommodated in the concave portion of the coil bobbin.

9. An induction heating roller apparatus wherein:

a heating roller for magnetically coupling to induction coils, generating heat with an induction current, and switching among a plurality of heating areas of different lengths according to a size of an object to be heated;

a plurality of induction coils separately arranged in the axial direction of the heating roller and opposed to the plurality of heating areas of the heating roller, the plurality of induction coils having sufficient length to extend out of both ends of any heating area;

a high frequency power supply for supplying high frequency power to the plurality of induction coils; and induction coil selection means for, by intervening between the high frequency power supply and induction coils, selectively supplying high frequency output of the high frequency power supply to the induction coils opposed to the heating areas of the heating roller according to the size of the object to be heated.

10. The induction heating roller apparatus according to claim 9, wherein the high frequency power supply is a frequency-variable high frequency power supply capable of feeding the power to the plurality of induction coils in common and having available output frequency; and wherein the induction coil selection means includes filter means which intervenes between a frequency-variable high frequency power supply and the induction coils and controls passing high frequency power by selectively operating according to the frequencies.

11. The induction heating roller apparatus according to claim 9, wherein the high frequency power supply is the frequency-variable high frequency power supply capable of feeding power to the plurality of induction coils in common and having a variable output frequency; and wherein the induction coil selection means includes a plurality of resonance circuits which intervene between a frequency-variable high frequency power supply and the induction coils, and the induction coils are resonance circuit elements and have resonance frequencies and Q values of different sizes.

12. The induction heating roller apparatus according to claim 9, wherein a pair of adjacent induction coils are adjacent in a state of different winding directions.

13. The induction heating roller apparatus according to claim 9, further comprising:

a high frequency transmission line for connecting the high frequency power supply and the induction coils;

power factor improvement means connected to the induction coils and placed at a position close to the induction coils for increasing a power factor of high frequency current running in the high frequency transmission line; and a matching circuit intervening between the high frequency power supply and the high frequency transmission line and placed close to the high frequency power supply.

14. The induction heating roller apparatus according to claim 13, further comprising:

a coil bobbin supporting the induction coils on a rim side and having a concave portion at least partially formed thereon; and wherein the power factor improvement means is accommodated in the concave portion of the coil bobbin.

15. A fixing apparatus comprising:

a fixing apparatus proper equipped with a pressing roller; and the induction heating roller apparatus according to claim 1 or 9 placed to fix a toner image with the heating roller placed to be facing the pressing roller of the fixing apparatus proper in a pressure welding relationship while carrying a recording medium having the toner image formed thereon sandwiched between the rollers.

16. An image formation apparatus comprising:

an image formation apparatus proper equipped with image formation means for forming a toner image on a recording medium; and the fixing apparatus according to claim 15 placed on the image formation apparatus proper for fixing the toner image on the recording medium.

* * * * *

UNITED STATES PATENT AND TRADEMARK OFFICE

CERTIFICATE OF CORRECTION

PATENT NO. : 6,850,728 B2
DATED : February 1, 2005
INVENTOR(S) : Yokozeki et al.

It is certified that error appears in the above-identified patent and that said Letters Patent is hereby corrected as shown below:

Column 30,
Line 2, change “available” to -- a variable --.

Signed and Sealed this

Twenty-fourth Day of May, 2005

JON W. DUDAS
*Director of the United States Patent and Trademark Office*